US010431146B2

(12) United States Patent
Sako et al.

(10) Patent No.: US 10,431,146 B2
(45) Date of Patent: Oct. 1, 2019

(54) DISPLAY DEVICE, ELECTRONIC APPARATUS, AND METHOD OF DRIVING DISPLAY DEVICE

(71) Applicant: Japan Display Inc., Tokyo (JP)

(72) Inventors: Kazuhiko Sako, Tokyo (JP); Kazunari Tomizawa, Tokyo (JP); Tsutomu Harada, Tokyo (JP); Naoyuki Takasaki, Tokyo (JP); Tae Kurokawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 108 days.

(21) Appl. No.: 15/672,699

(22) Filed: Aug. 9, 2017

(65) Prior Publication Data

US 2018/0061310 A1 Mar. 1, 2018

(30) Foreign Application Priority Data

Aug. 31, 2016 (JP) ..... 2016-169584

(51) Int. Cl.
*G09G 3/22* (2006.01)
*G09G 3/34* (2006.01)
(Continued)

(52) U.S. Cl.
CPC ..... *G09G 3/22* (2013.01); *G09G 3/2003* (2013.01); *G09G 3/342* (2013.01); *G09G 3/3406* (2013.01);
(Continued)

(58) Field of Classification Search
CPC ..... G09G 3/2003; G09G 3/22; G09G 3/3413; G09G 3/3406; G09G 3/3607; G09G 3/342;
(Continued)

(56) References Cited

U.S. PATENT DOCUMENTS 8,421,740 B2 * 4/2013 Watanuki ..... G09G 3/3426 345/102
2009/0207182 A1 * 8/2009 Takada ..... G09G 3/3406 345/589
(Continued)

FOREIGN PATENT DOCUMENTS

JP 2011-154323 A 8/2011
JP 2016-161921 A 9/2016

*Primary Examiner* — Amare Mengistu
*Assistant Examiner* — Jennifer L Zubajlo
(74) *Attorney, Agent, or Firm* — Michael Best & Friedrich LLP

(57) ABSTRACT

A signal processor of a display device includes: a light emission value calculating unit that calculates a light emission value; a chunk determining unit that determines whether pixels within a predetermined luminance value range are continuously present and determines an area of the continuous pixels as a chunk; a maximum luminance value detecting unit that detects a maximum luminance value inside the chunk in one of the partial areas; a luminance gain value determining unit that determines a luminance gain value based on the maximum luminance value such that a corrected light emission value that is a value acquired by multiplying the light emission value by the luminance gain value is a value of an upper limit emission value or less; and a light emission control unit that causes the light source units to emit light based on the corrected light emission value.

11 Claims, 21 Drawing Sheets

(51) Int. Cl.
*G09G 3/20* (2006.01)
*G09G 3/36* (2006.01)

(52) U.S. Cl.
CPC ..... *G09G 3/3413* (2013.01); *G09G 3/3607* (2013.01); *G09G 2300/0426* (2013.01); *G09G 2300/0452* (2013.01); *G09G 2320/02* (2013.01); *G09G 2320/0673* (2013.01); *G09G 2330/021* (2013.01); *G09G 2340/06* (2013.01); *G09G 2360/16* (2013.01); *G09G 2370/08* (2013.01)

(58) Field of Classification Search
CPC ... G09G 2300/0452; G09G 2300/0426; G09G 2320/02; G09G 2320/0673; G09G 2330/021; G09G 2340/06; G09G 2360/16; G09G 2370/08
See application file for complete search history.

(56) References Cited

U.S. PATENT DOCUMENTS

| | | | | |
|---|---|---|---|---|
| 2011/0181635 | A1* | 7/2011 | Kabe | G09G 3/3426 345/694 |
| 2015/0221268 | A1 | 8/2015 | Kabe et al. | |
| 2016/0260395 | A1* | 9/2016 | Sako | G09G 3/3607 |
| 2016/0300522 | A1* | 10/2016 | Takasaki | G09G 3/342 |

* cited by examiner

FIG.8B

| | |
|---|---|
| DIVISION LUMINANCE RANGE A | 236 TO 255 |
| DIVISION LUMINANCE RANGE B | 216 TO 235 |
| DIVISION LUMINANCE RANGE C | 196 TO 215 |
| DIVISION LUMINANCE RANGE D | 176 TO 195 |
| DIVISION LUMINANCE RANGE E | 156 TO 175 |

DISPLAY DEVICE, ELECTRONIC APPARATUS, AND METHOD OF DRIVING DISPLAY DEVICE

CROSS-REFERENCE TO RELATED APPLICATIONS

This application claims priority from Japanese Application No. 2016-169584, filed on Aug. 31, 2016, the contents of which are incorporated by reference herein in its entirety.

BACKGROUND

1. Technical Field

The present disclosure relates to a display device, an electronic apparatus, and a method of driving a display device.

2. Description of the Related Art

In recent years, the demand for display devices used for portable devices such as a cellular phone and electronic paper has increased. In such a display device, one pixel includes a plurality of sub pixels, and the plurality of sub pixels output light of mutually-different colors, and, by switching on/off of the display of the sub pixel, various colors are displayed by one pixel. In such a display device, display characteristics such as resolution and luminance have been improved year by year. However, as the resolution is increased, the aperture ratio decreases. Therefore, in order to achieve a high luminance, the luminance of a back light needs to be high, and the power consumption of the back light will increase.

In order to prevent the power consumption from increasing, there is a technology of adding a white pixel that is a fourth sub pixel to conventional sub pixels of red, green, and blue (for example, Japanese Patent Application Laid-open Publication No. 2011-154323). According to this technology, the emission amount of the back light is decreased in correspondence with the improvement of the luminance corresponding to the white pixel, and accordingly, the power consumption is reduced.

In recent years, it is requested to display an image brighter. In addition, in a case where the image is displayed brighter as above, there are cases where the suppression of degradation of the display quality is requested while the power consumption is suppressed. There is a room for the improvement in the signal processing in such cases.

For foregoing reason, there is a need of a display device, an electronic apparatus, and a method of driving a display device capable of suppressing the degradation of the display quality while suppressing the power consumption.

SUMMARY

According to an aspect, a display device includes: an image display panel in which a plurality of pixels are arranged in a matrix pattern; a plurality of light source units that are respectively arranged in correspondence with a plurality of partial areas acquired by dividing the area of an image display surface of the image display panel and emit light to the corresponding partial areas; and a signal processor that controls the pixels based on an input signal of an image and controls emission amounts of light of the light source units. The signal processor includes: a light emission value calculating unit that calculates a light emission value for each of the plurality of the light source units based on the input signal, the light emission value is an emission amount of light of each of the light source units; a luminance calculating unit that calculates luminances of the pixels based on the input signal; a chunk determining unit that determines whether pixels within a predetermined luminance value range are continuously present among the plurality of the pixels and determines an area of the continuous pixels as a chunk; a maximum luminance value detecting unit that detects a maximum luminance value for each of the partial areas, the maximum luminance value is a maximum luminance among luminances of the pixels disposed inside the chunk in one of the partial areas; a luminance gain value determining unit that determines a luminance gain value for each of the partial areas based on the maximum luminance value, such that a corrected light emission value that is a value acquired by multiplying the light emission value by the luminance gain value is a value of a predetermined upper limit emission value set in advance or less; and a light emission control unit that causes the plurality of the light source units to emit light based on the corrected light emission value.

According to an aspect, in a method of driving a display device, the display device includes an image display panel in which a plurality of pixels are arranged in a matrix pattern and a plurality of light source units that are respectively arranged in correspondence with a plurality of partial areas acquired by dividing the area of an image display surface of the image display panel and emit light to the corresponding partial areas. The method includes: a light emission value calculating step of calculating a light emission value for each of the plurality of the light source units based on the input signal of the pixels, the light emission value, the light emission value is an emission amount of light of each of the light source units; a chunk determining step of determining whether pixels within a predetermined luminance value range are continuously present among the plurality of the pixels and determining an area of the continuous pixels as a chunk; a maximum luminance value detecting step of detecting a maximum luminance value for each of the partial areas, the maximum luminance value is a maximum luminance among luminances of the pixels disposed inside the chunk in one of the partial areas; a luminance gain value determining step of determining a luminance gain value for each of the partial areas based on the maximum luminance value, such that a corrected light emission value that is a value acquired by multiplying the light emission value by the luminance gain value is a value of a predetermined upper limit emission value set in advance or less; and a light emission controlling step of causing the plurality of the light source units to emit light based on the corrected light emission value.

According to an aspect, a display device includes: an image display panel in which a plurality of pixels are arranged in a matrix pattern; a plurality of light source units that are respectively arranged in correspondence with a plurality of partial areas acquired by dividing the area of an image display surface of the image display panel and emit light to the corresponding partial areas; and a signal processor that controls the pixels based on an input signal of an image and controls emission amounts of light of the light source units. The signal processor includes: a light emission value calculating unit that calculates a light emission value for each of the plurality of the light source units based on the input signal, the light emission value is an emission amount of light of each of the light source units; a luminance calculating unit that calculates luminances of the pixels based on the input signal; a chunk determining unit that determines whether pixels within a predetermined luminance value range are continuously present among the plurality of the pixels and determines an area of the continuous pixels as a chunk; a maximum luminance value detecting unit that detects a maximum luminance value for each of the partial areas, the maximum luminance value is a maximum luminance among luminances of the pixels disposed inside the chunk in one of the partial areas; and a luminance gain value determining unit that determines a luminance gain value for each of the partial areas based on the maximum luminance value, such that a corrected light emission value that is a value acquired by multiplying the light emission value by the luminance gain value is a value of a predetermined upper limit emission value set in advance or less, and the luminance gain value is larger as the partial area has a higher maximum luminance value.

BRIEF DESCRIPTION OF THE DRAWINGS

FIG. 8B is a table that illustrates an example of luminance ranges;

DETAILED DESCRIPTION

Figure 1:
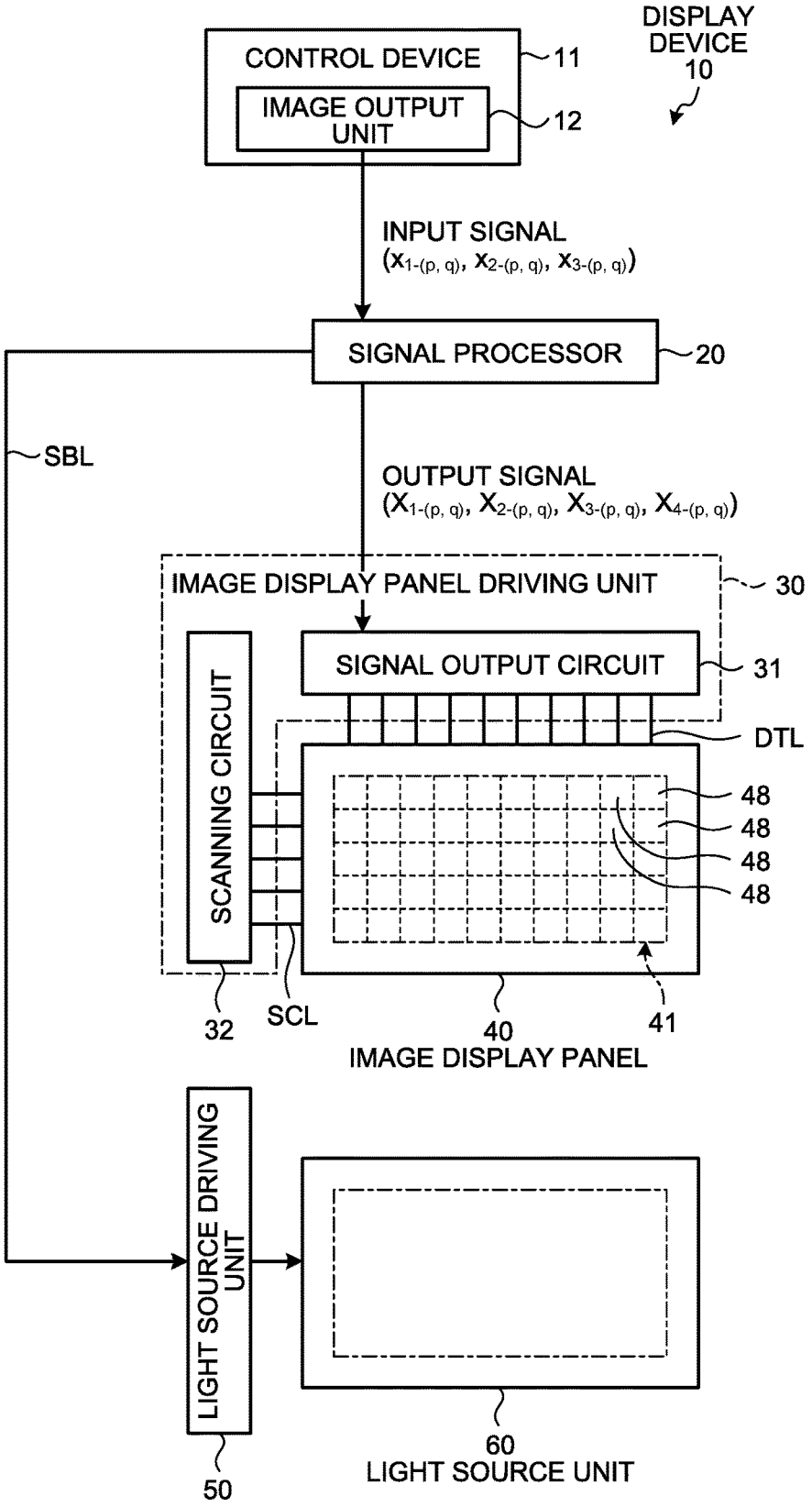
FIG. 1 is a block diagram that illustrates an example of the configuration of a display device according to a first embodiment.

Hereinafter, embodiments of the present invention will be described with reference to the drawings. In addition, the disclosure is merely an example, and it is apparent that an appropriate change that can be acquired by a person skilled in the art with the main concept of the present invention being maintained belongs to the scope of the present invention. In addition, while the drawing is for further clarification of the description, and there are cases where the width, the thickness, the shape, and the like of each unit are illustrated more schematically than those of an actual form, these are merely an example, and the interpretation of the present invention is not limited thereto. Furthermore, in the present specification and each diagram, a same reference numeral is assigned to each element similar to that described in a former diagram, and detailed description thereof may not be presented as is appropriate.

First Embodiment

Overall Configuration of Display Device

Figure 2:
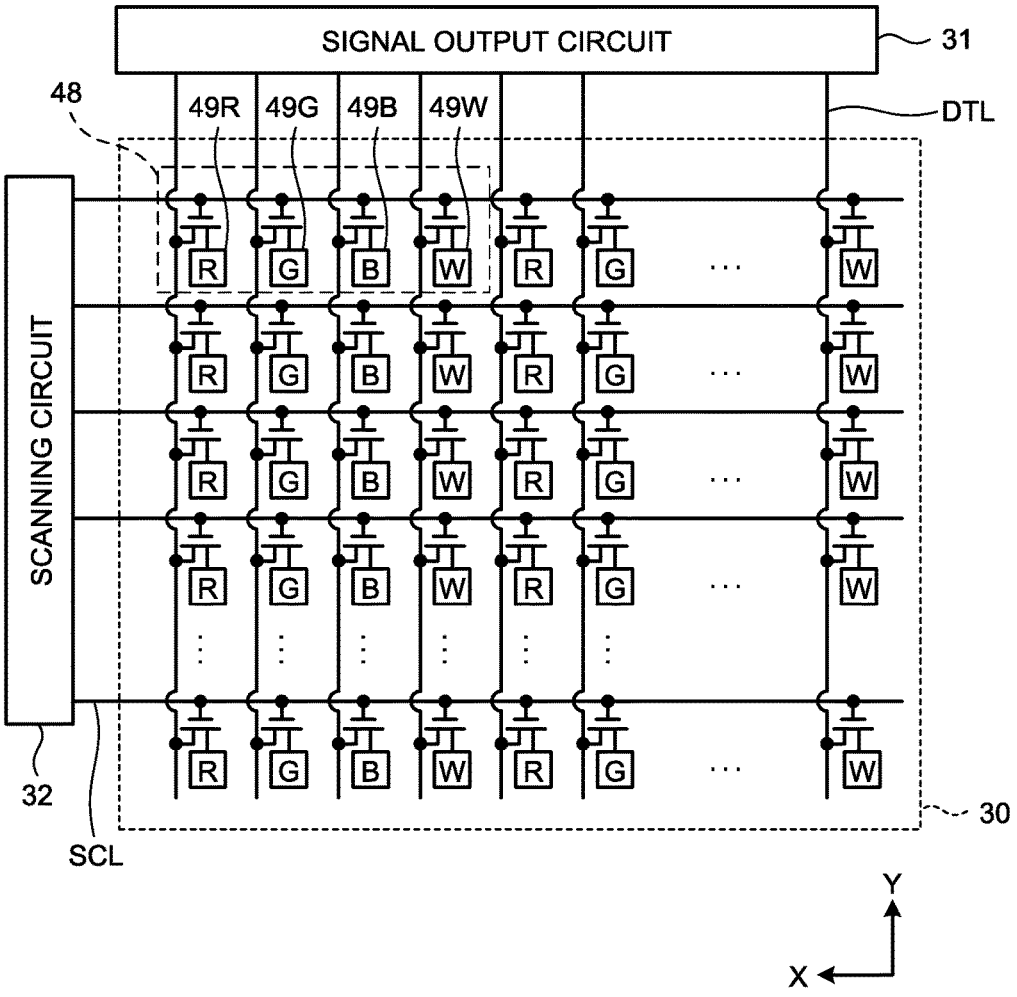
FIG. 2 is a conceptual diagram of an image display panel according to the first embodiment.

FIG. 1 is a block diagram that illustrates an example of the configuration of a display device according to a first embodiment. FIG. 2 is a conceptual diagram of an image display panel according to the first embodiment. As illustrated in FIG. 1, a display device 10 according to the first embodiment includes: a signal processor 20; an image display panel driving unit (driver) 30; an image display panel 40; a light source driving unit 50; and a light source unit 60. The signal processor 20 has an input signal (RGB data) input thereto from an image output unit 12 of a control device 11, performs a predetermined data converting process for the input signal, and transmits a generated signal to each unit of the display device 10. The image display panel driving unit (driver) 30 controls the driving of the image display panel 40 based on a signal transmitted from the signal processor 20. The light source driving unit 50 controls the driving of the light source unit 60 based on a signal transmitted from the signal processor 20. The light source unit (light source device) 60 illuminates the image display panel 40 based on a signal transmitted from the light source driving unit (driver) 50 from the rear face. The image display panel 40 displays an image based on a signal transmitted from the image display panel driving unit 30 and light transmitted from the light source unit 60.

Configuration of Image Display Panel

First, the configuration of the image display panel 40 will be described. As illustrated in FIGS. 1 and 2, in the image display panel 40, $P_0 \times Q_0$ pixels 48 ($P_0$ pixels in the row direction and $Q_0$ pixels in the row direction) are arranged in a two-dimensional matrix pattern (matrix pattern) on an image display surface 41 used for displaying an image. In the example illustrated in FIG. 1, an example is illustrated in which a plurality of the pixels 48 are arranged in a matrix pattern in a two dimensional XY coordinate system. In this example, while the X direction is a horizontal direction (row direction), and the Y direction is a vertical direction (column direction), the directions are not limited thereto. Thus, it may be configured such that the X direction is a vertical direction, and the Y direction is a horizontal direction.

Each of the pixels 48 includes a first sub pixel 49R, a second sub pixel 49G, a third sub pixel 49B, and a fourth sub pixel 49W. The first sub pixel 49R displays a first color (for example, a red color). The second sub pixel 49G displays a second color (for example, a green color). The third sub pixel 49B displays a third color (for example, a blue color). The fourth sub pixel 49W displays a fourth color (for example, a white color). The first color, the second color, the third color, and the fourth color are not respectively limited to the red color, the green color, the blue color, and the white color but may be complementary colors and the like, and the colors may have differences from one another. In the case of being emitted with a same light source lighting amount, it is preferable that the fourth sub pixel 49W displaying the fourth color has a luminance higher than the first sub pixel 49R displaying the first color, the second sub pixel 49G displaying the second color, and the third sub pixel 49B displaying the third color. Hereinafter, in a case where the first sub pixel 49R, the second sub pixel 49G, the third sub pixel 49B, and the fourth sub pixel 49W do not need to be discriminated from one another, it will be referred to as a sub pixel 49. In addition, in a case where a sub pixel is to be described with the position at which the sub pixel is arranged discriminated from each other, for example, a fourth sub pixel of a pixel $\mathbf{48}_{(p,\ q)}$ will be described as a fourth sub pixel $\mathbf{49}W_{(p,\ q)}$.

The image display panel 40 is a color liquid crystal display panel, and a first color filter passing the first color is arranged between the first sub pixel 49R and an image observer, a second color filter passing the second color is arranged between the second sub pixel 49G and the image observer, and a third color filter passing the third color is arranged between the third sub pixel 49B and the image observer. In addition, in the image display panel 40, a color filter is not arranged between the fourth sub pixel 49W and the image observer. In the fourth sub pixel 49W, a transparent resin layer may be arranged instead of the color filter. By arranging the transparent resin layer in the image display panel 40 in this way, a large level difference of the fourth sub pixel 49W generated by not arranging the color filter in the fourth sub pixel 49W can be suppressed.

Configuration of Image Display Panel Driving Unit

As illustrated in FIGS. 1 and 2, the image display panel driving unit 30 includes a signal output circuit 31 and a scanning circuit 32. The image display panel driving unit 30 maintains a video signal and sequentially outputs the video signal to the image display panel 40 by using the signal output circuit 31. In more details, the signal output circuit 31 outputs an image output signal having predetermined electric potential according to an output signal output from the signal processor 20 to the image display panel 40. The signal output circuit 31 is electrically connected to the image display panel 40 by using signal lines DTL. The scanning circuit 32 controls on/off of switching devices (for example, TFTs) used for controlling the operations (light transmittance) of the sub pixels 49 of the image display panel 40. The scanning circuit 32 is electrically connected to the image display panel 40 by using wirings SCL.

Configuration of Light Source Driving Unit and Light Source Unit

Figure 3:
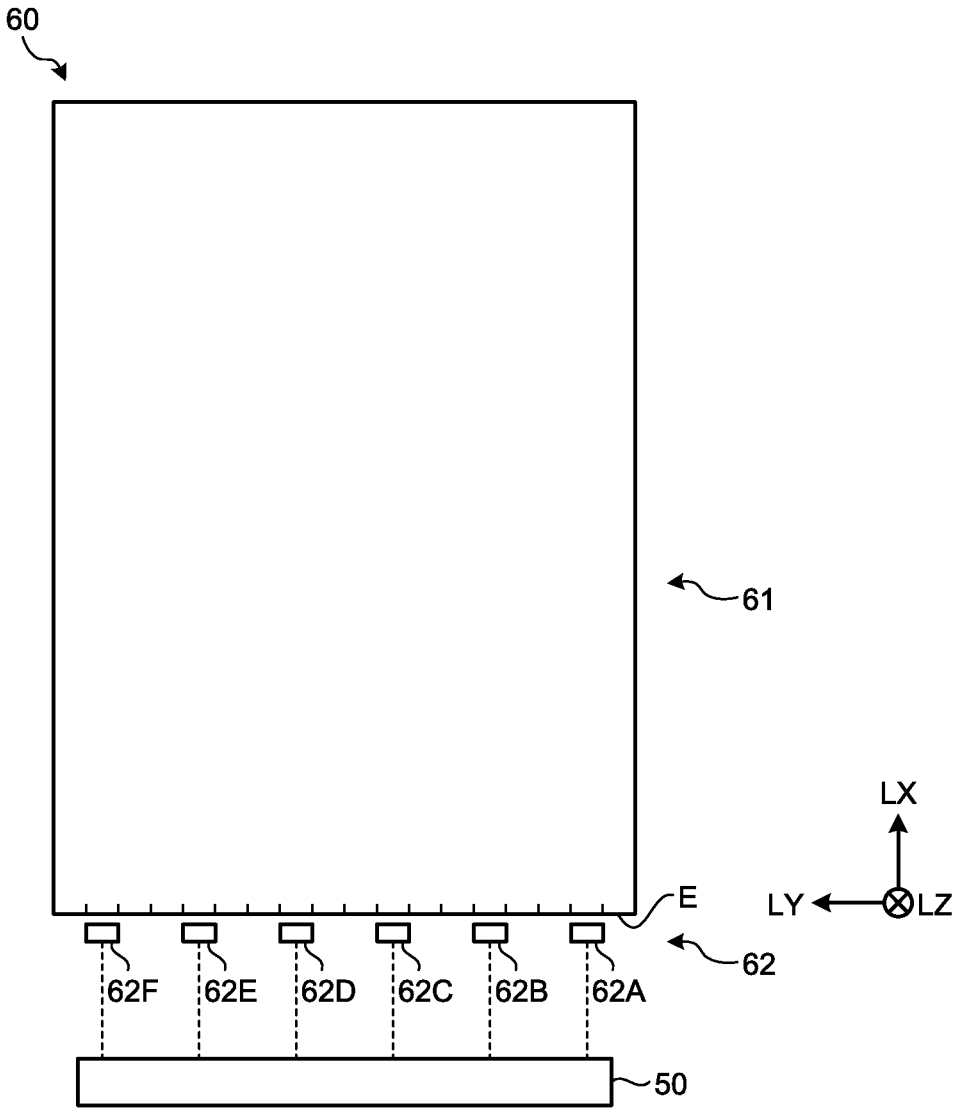
FIG. 3 is an explanatory diagram of a light source unit according to this embodiment.

The light source unit 60 is arranged on the rear face of the image display panel 40 and lights the image display panel 40 by emitting light toward the image display panel 40. FIG. 3 is an explanatory diagram of the light source unit according to this embodiment. The light source unit 60 includes a light guiding plate 61 and a plurality of light source units 62A, 62B, 62C, 62D, 62E, and 62F at positions facing an incident surface E with at least one side face of the light guiding plate 61 used as the incident surface E. The plurality of light source units 62A, 62B, 62C, 62D, 62E, and 62F are, for example, light emitting diodes (LEDs) of a same color (for example, a white color). The plurality of light source units 62A, 62B, 62C, 62D, 62E, and 62F are aligned along one side face of the light guiding plate 61, and a light source arrangement direction in which the light source units 62A, 62B, 62C, 62D, 62E, and 62F are aligned is set as a direction LY. In this case, incident light of the light source units 62A, 62B, 62C, 62D, 62E, and 62F is incident from the incident surface E to the light guiding plate 61 in an incident light direction LX that is orthogonal to the light source arrangement direction LY. Hereinafter, in a case where the light source units 62A, 62B, 62C, 62D, 62E, and 62F do not need to be discriminated from each other, each thereof will be described as a light source unit 62. The number and the arrangement of the light source units 62 illustrated in FIG. 3 are examples, the number of the light source units 62 is an arbitrary number of two or more, and the arrangement is arbitrary.

The light source driving unit 50 controls the light intensity and the like of light output by the light source unit 60. More specifically, the light source driving unit 50 adjusts a current or a duty ratio supplied to the light source unit 60 based on a planar light source device control signal SBL output from the signal processor 20, thereby controlling the emission amount of light (the intensity of light) emitted to the image display panel 40. Then, the light source driving unit 50 individually and independently controls the current or the duty ratio of the plurality of light source units 62 illustrated in FIG. 3, thereby capable of performing divided drive control of the light sources by which the emission amount of light (the intensity of light) emitted by each light source unit 62 is controlled.

In the light guiding plate 61, light is reflected on both end faces appearing in the light source arrangement direction LY. Accordingly, there is a difference between: an intensity distribution of light emitted by the light source unit 62A and the light source unit 62F which are close to both the end faces appearing in the light source arrangement direction LY; and an intensity distribution of light, for example, emitted by the light source unit 62C arranged between the light source unit 62A and the light source unit 62F. For this reason, the light source driving unit 50 according to this embodiment needs to control the amount of light (the intensity of light) to be emitted in accordance with the light intensity distribution of each light source unit 62 by individually and independently controlling the currents or the duty ratios of the plurality of light source units 62 illustrated in FIG. 3.

In the light source unit 60, incident light of the light source unit 62 is emitted in an incident light direction LX that is orthogonal to the light source arrangement direction LY and enters the light guiding plate 61 from the incident surface E. The light incident to the light guiding plate 61 travels in the incident light direction LX while diffusing. The light guiding plate 61 emits the light from the light source unit 62 and incident thereto in a lighting direction LZ in which the image display panel 40 is lighted from the rear face. Here, the rear face of the image display panel 40 is a face disposed on the opposite side of the image display surface 41. In this embodiment, the lighting direction LZ is orthogonal to the light source arrangement direction LY and the incident light direction LX.

Figure 4:
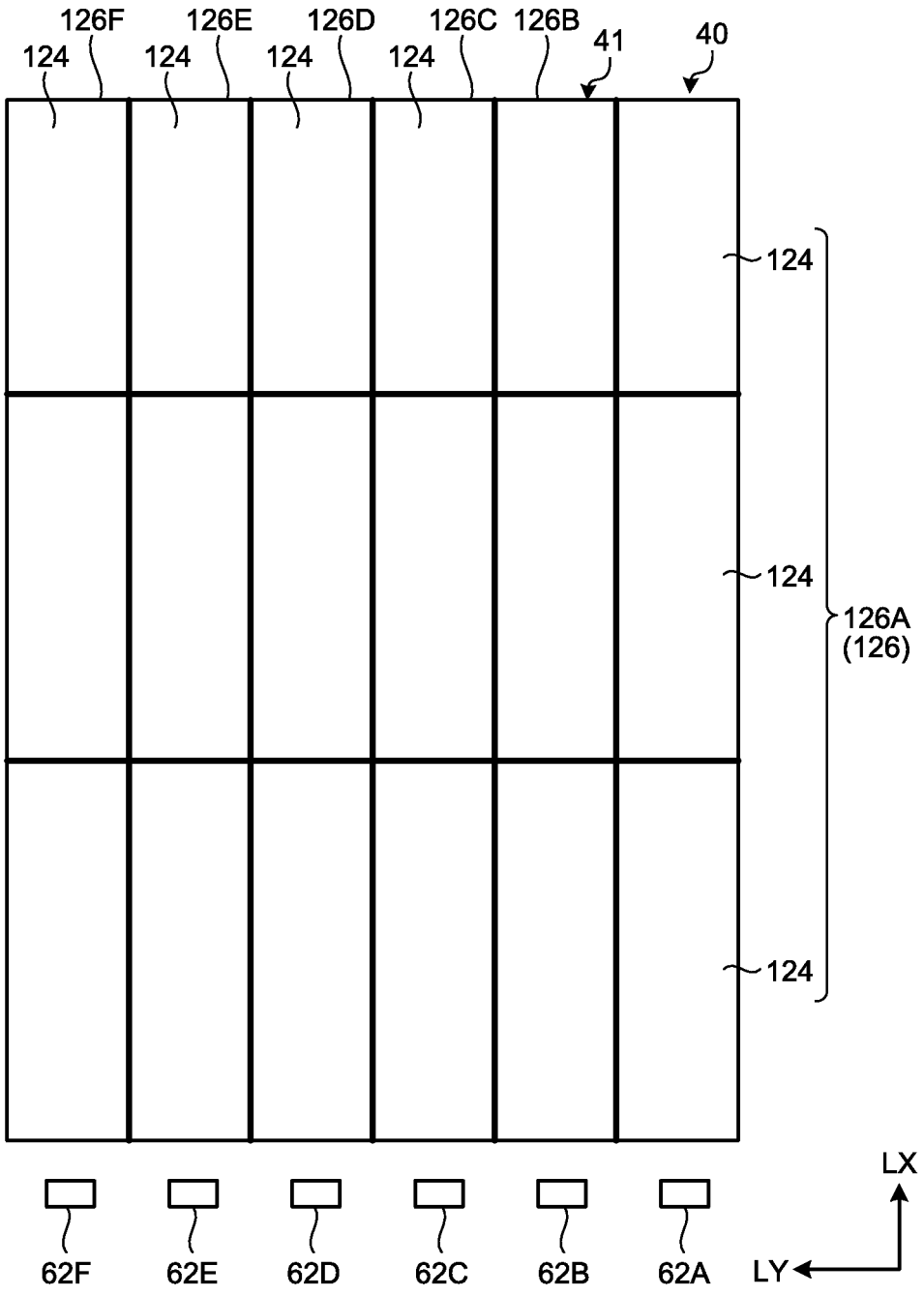
FIG. 4 is a schematic diagram that illustrates an image display surface.

FIG. 4 is a schematic diagram that illustrates an image display surface. In the display device 10 according to this embodiment, the image display surface 41 of the image display panel 40 is virtually partitioned into a plurality of areas 124. A total of 18 areas 124 of three rows along the incident light direction LX and six columns along the light source arrangement direction LY are arranged on the image display surface 41. However, the number of the areas 124 is not limited to 18 but is arbitrarily set. Three areas 124 arranged along the incident light direction LX form a partial area 126. Six partial areas 126 are arranged in the light source arrangement direction LY. In the example illustrated in FIG. 4, partial areas 126A, 126B, 126C, 126D, 126E, and 126F are arranged in the light source arrangement direction LY as the partial areas 126. The partial areas 126A are disposed in correspondence with the light source unit 62A and has light emitted from the light source unit 62A emitted thereto. Similarly, the partial areas 126B, 126C, 126D, 126E, and 126F are respectively disposed in correspondence with the light source units 62B, 62C, 62D, 62E, and 62F and have light emitted from the light source units 62B, 62C, 62D, 62E, 62F emitted thereto.

In this way, the partial areas 126 can be regarded as a plurality of areas acquired by dividing the area of the image display surface 41. Inside the partial area 126, a plurality of pixels 48 are arranged. The number of the partial areas 126 is the same as the number of the light source units 62.

Configuration of Signal Processor

The signal processor 20 controls the pixels 48 based on an input signal of an image and controls the emission amount of light of the light source unit 62. The signal processor 20 processes an input signal input from the control device 11, thereby generating an output signal. The signal processor 20 converts an input value of an input signal used for displaying by combining the colors of the red color (first color), the green color (second color), and the blue color (third color) into an extended value (output value) in an extended color space (a HSV (Hue-Saturation-Value, Value is also called Brightness) color space in the first embodiment) extended using the red color (first color), the green color (second color), the blue color (third color), and the white color (fourth color) to be generated. Then, the signal processor 20 outputs the generated output signal to the image display panel driving unit 30. The extended color space will be described later. In the first embodiment, while the extended color space is the HSV color space, the extended color space is not limited thereto but may be an XYZ color space, a YUV space, or any other coordinate system. In addition, the signal processor 20 also generates a planar light source device control signal SBL to be output to the light source driving unit 50.

Figure 5:
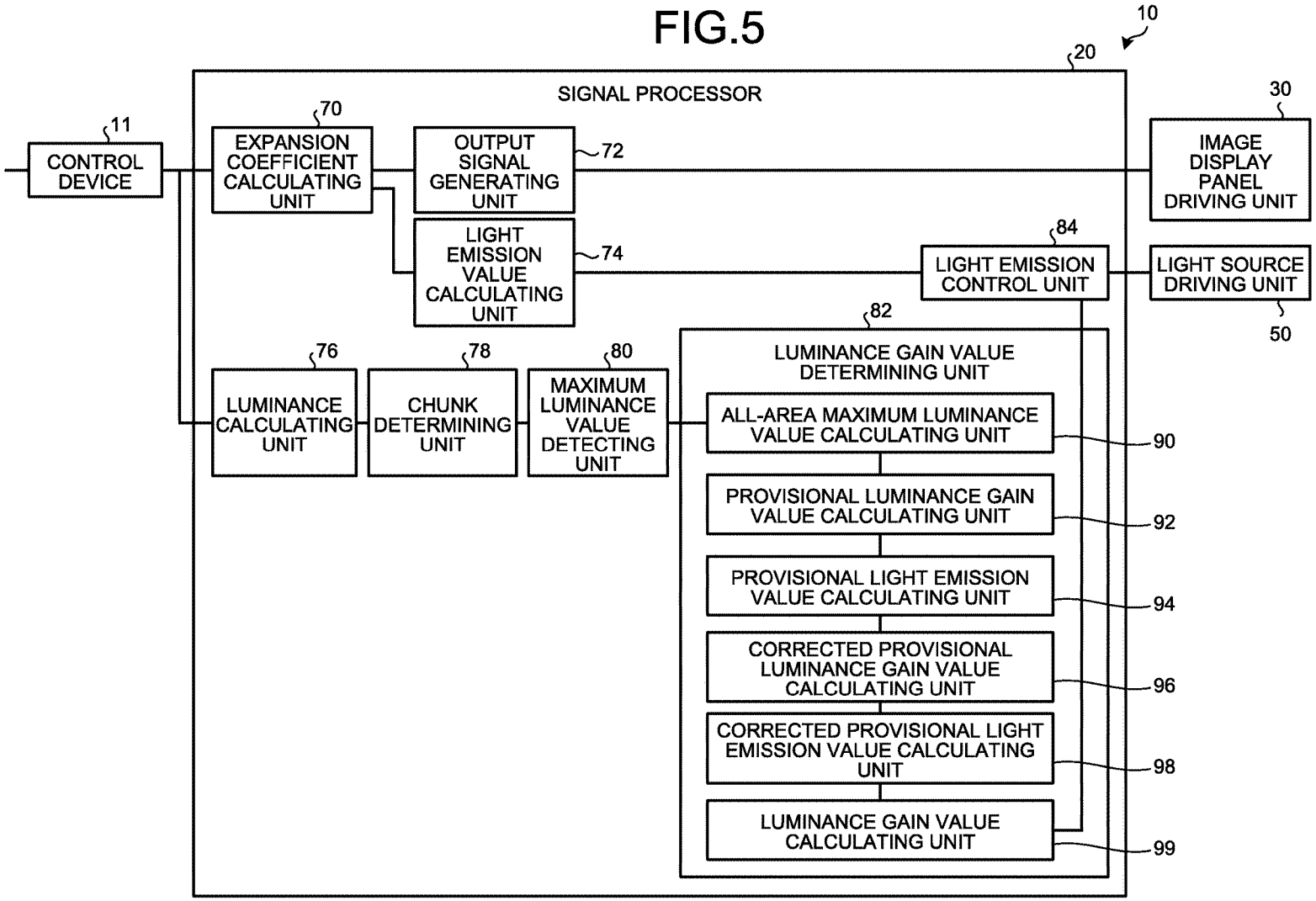
FIG. 5 is a block diagram that illustrates an overview of the configuration of a signal processor according to the first embodiment.

FIG. 5 is a block diagram that illustrates an overview of the configuration of the signal processor according to the first embodiment. As illustrated in FIG. 5, the signal processor 20 includes: an expansion coefficient calculating unit 70; an output signal generating unit 72; a light emission value calculating unit 74; a luminance calculating unit 76; a chunk determining unit 78; a maximum luminance value detecting unit 80; a luminance gain value determining unit 82; and a light emission control unit 84. The expansion coefficient calculating unit 70 calculates an expansion coefficient $\alpha$ that is a coefficient used for expanding an input signal. The output signal generating unit 72 generates output signals of the pixels 48. The light emission value calculating unit 74, the luminance calculating unit 76, the chunk determining unit 78, the maximum luminance value detecting unit 80, the luminance gain value determining unit 82, and the light emission control unit 84 calculate the emission amount of light of the light source unit 62, in other words, a corrected light emission value. Such units of the signal processor 20 may be configured to be independent from each other (for example, circuits or the like) or may be configured to be common.

The expansion coefficient calculating unit 70 acquires an input signal of an image from the control device 11 and calculates an expansion coefficient $\alpha$ for each pixel 48. The expansion coefficient calculating unit 70 calculates an expansion coefficient $\alpha$ for each of all the pixels 48 of the image display panel 40. The expansion coefficient calculating unit 70, for each pixel 48, calculates the saturation and the value of colors displayed based on an input signal and calculates an expansion coefficient $\alpha$ based thereon. A method of calculating an expansion coefficient $\alpha$ by using the expansion coefficient calculating unit 70 will be described later.

The output signal generating unit 72 acquires information of the expansion coefficient $\alpha$ from the expansion coefficient calculating unit 70. The output signal generating unit 72 generates an output signal used for causing each pixel 48 to display a predetermined color based on the value of the expansion coefficient $\alpha$ and an input signal. The output signal generating unit 72 outputs the generated output signal to the image display panel driving unit 30. The process of generating an output signal by using the output signal generating unit 72 will be described later.

The light emission value calculating unit 74 calculates a light emission value $1/\alpha$ for each light source unit 62, in other words, for each partial area 126, based on the expansion coefficient $\alpha$ of each pixel 48. The light emission value $1/\alpha$ represents the emission amount of light emitted by the light source unit 62, and, in this embodiment, the light source unit 62 is caused to emit light by using a value acquired by expanding the light emission value $1/\alpha$. In the first embodiment, as the light emission value $1/\alpha$ is increased, the light source lighting amount of the light source unit 62 increases. On the other hand, as the light emission value $1/\alpha$ is decreased, the light source lighting amount of the light source unit 62 decreases.

The luminance calculating unit 76 calculates the luminance L of each pixel 48 based on an input signal of each pixel 48. The luminance calculating unit 76 calculates a luminance L for each of all the pixels 48 of the image display panel 40. A method of calculating a luminance L by using the luminance calculating unit 76 will be described later.

The chunk determining unit 78 performs chunk detection based on the luminance L. The chunk determining unit 78 determines whether or not pixels 48 within a predetermined luminance value range among the pixels 48 disposed inside the image display surface 41 are continuously present. The chunk determining unit 78 determines an area (pixel group) of pixels 48 determined to be continuous as a chunk. A more detailed method of detecting a chunk by using the chunk determining unit 78 will be described later.

The maximum luminance value detecting unit 80 detects a maximum luminance value that is a maximum luminance among the luminance values of pixels 48 disposed within the chunk in one partial area 126. The maximum luminance value detecting unit 80 detects the maximum luminance value for each partial area 126.

The luminance gain value determining unit 82 determines a luminance gain value for each partial area 126. The luminance gain value is a gain value used for increasing the emission amount of light emitted to each pixel by expanding a light emission value. Hereinafter, a value acquired by multiplying the light emission value by the luminance gain value will be referred to as a corrected light emission value. The corrected light emission value is the value of the emission amount of light that is actually emitted by the light source unit 62, which will be described later in detail.

The luminance gain value determining unit 82 determines a luminance gain value such that the corrected light emission value is a value of an upper limit light emission value set in advance or less. In addition, the luminance gain value determining unit 82 sets the luminance gain value to be larger as the partial area 126 has a higher maximum luminance value.

In addition, the luminance gain value determining unit 82 calculates a luminance gain value such that the corrected light emission value of each of a plurality of the partial areas 126 has a value that is an individual upper limit emission value or less. The individual upper limit emission value is a value set advance as the upper limit emission amount of light that can be emitted by one light source unit 62. In other words, the individual upper limit emission value is an emission amount upper limit value of light that can be emitted by one light source unit 62, and, for example, even in a case where the power is further raised, the light source unit 62 cannot realize a emission amount more than that.

In addition, the luminance gain value determining unit 82 calculates a luminance gain value such that a sum value of corrected light emission values of all the partial areas 126 is a value of a sum upper limit emission value or less. The sum upper limit emission value is a value set in advance as an upper limit value of a sum of emission amounts of all the light source units 62. The sum upper limit value is an upper limit value of the sum of power consumption amounts of the light source units 62. The power consumption amount of the light source unit 62 is proportional to the emission amount of light, and accordingly, as the corrected light emission value is larger, the power consumption amount is higher. Accordingly, in a case where a sum value of corrected light emission values of all the partial areas 126 exceeds the sum upper limit emission value, power for emitting light that corresponds to the excess becomes insufficient, and there are cases where light corresponding to the excess cannot be emitted by the display device 10.

The sum upper limit emission value is smaller than a value acquired by multiplying the individual upper limit emission value by a total number of the partial areas 126. The sum upper limit emission value is determined by a sum emission amount of a case where the emission amounts of all the partial areas 126 are 100% (for example, 255), and a sum value of the corrected light emission values is set not to exceed the sum upper limit emission value. In addition, the individual upper limit emission value is a value exceeding 100% of the emission amount of the partial area 126. In addition, it is preferable that the sum upper limit emission value is a value not significantly exceeding a sum emission amount of a case where the emission amounts of all the partial areas 126 are 100% (for example, 255). More specifically, it is preferable that the sum upper limit emission value is a value that is 1.0 times or more and 1.2 times or less of the sum emission amount of a case where the emission amounts of a case where all the partial areas 126 are 100% (for example, 255).

As illustrated in FIG. 5, the luminance gain value determining unit 82 according to the first embodiment includes: an all-area maximum luminance value calculating unit 90; a provisional luminance gain value calculating unit 92; a provisional light emission value calculating unit 94; a corrected provisional luminance gain value calculating unit 96; a corrected provisional light emission value calculating unit 98; and a luminance gain value calculating unit 99.

The all-area maximum luminance value calculating unit 90 detects an all-area maximum luminance value that is maximum luminance among the maximum luminance values of all the partial areas 126. Hereinafter, a partial area 126 to which the pixel 48 having the all-area maximum luminance value belongs will be described as a maximum partial area 126M.

The provisional luminance gain value calculating unit 92 calculates a provisional luminance gain value for each partial area 126. In more details, the provisional luminance gain value calculating unit 92 calculates a provisional luminance gain value of the maximum partial area 126M such that the provisional luminance gain value of the maximum partial area 126M is a set gain value that is set in advance. In addition, the provisional luminance gain value calculating unit 92 calculates a provisional luminance gain value for each partial area 126 such that the provisional luminance gain value is smaller as the partial area 126 has a smaller maximum luminance value.

The provisional light emission value calculating unit 94 calculates a provisional light emission value for each partial area 126. The provisional light emission value is a value acquired by multiplying the provisional luminance gain value by the light emission value. In other words, the provisional light emission value is a value acquired by provisionally expanding the light emission value by using the provisional luminance gain value.

The corrected provisional luminance gain value calculating unit 96 calculates a corrected provisional luminance gain value for each partial area 126. The corrected provisional luminance gain value is a value acquired by correcting the provisional luminance gain value. The corrected provisional luminance gain value calculating unit 96 calculates a corrected provisional luminance gain value such that the corrected provisional luminance gain value is a value that is the provisional luminance gain value of the same partial area 126 or less. In more details, the corrected provisional luminance gain value calculating unit 96 calculates a corrected provisional luminance gain value such that a value acquired by multiplying the corrected provisional luminance gain value by the light emission value is the individual upper limit emission value or less.

The corrected provisional light emission value calculating unit 98 calculates a corrected provisional light emission value for each partial area 126. The corrected provisional light emission value is a value acquired by multiplying the corrected provisional luminance gain value by the light emission value. In other words, the corrected provisional light emission value is a value acquired by provisionally expanding the light emission value by using the corrected provisional luminance gain value.

The luminance gain value calculating unit 99 calculates a luminance gain value for each partial area 126. The luminance gain value is a value acquired by correcting the corrected provisional luminance gain value. The luminance gain value calculating unit 99 calculates a luminance gain value such that the luminance gain value is a value that is the corrected provisional luminance gain value of the same partial area 126 or less. In more details, the luminance gain value calculating unit 99 calculates a luminance gain value such that a sum value of values acquired by multiplying the luminance gain value by the light emission values for each partial area 126 is a value that is the sum upper limit emission value or less.

The light emission control unit 84 causes a plurality of the light source units 62 to emit light based on the corrected light emission value. The corrected light emission value is a value acquired by multiplying the light emission value by the luminance gain value. The light emission control unit 84 acquires a light emission value of each partial area 126 from the light emission value calculating unit 74. Then, the light emission control unit 84 acquires a luminance gain value from the luminance gain value determining unit 82 (luminance gain value calculating unit 99). The light emission control unit 84 calculates a corrected light emission value by multiplying a light emission value corresponding to the partial area 126 with the luminance gain value for each partial area 126. The light emission control unit 84 generates a planar light source device control signal SBL based on the corrected light emission value and outputs the planar light source device control signal SBL to the light source driving unit 50. The planar light source device control signal SBL can be regarded as a signal used for causing each light source unit 62 to emit light with a corresponding corrected light emission value. The process of calculating the corrected light emission value described above will be described in detail later.

Process of Generating Output Signal

Next, the process of generating an output signal of the pixel 48 by using the signal processor 20 will be described. Hereinafter, an input signal value for a first sub pixel 49R of a (p, q)-th pixel $\mathbf{48}_{(p,\ q)}$ will be denoted by an input signal value $x_{1-(p,\ q)}$, an input signal value for a second sub pixel 49G of the pixel $\mathbf{48}_{(p,\ q)}$ will be denoted by an input signal value $x_{2-(p,\ q)}$, and an input signal value for a third sub pixel 49B of the pixel $\mathbf{48}_{(p,\ q)}$ will be denoted by an input signal value $x_{3-(p,\ q)}$. The output signal generating unit 72, by performing an extension process for the input signal value $x_{1-(p,\ q)}$, the input signal value $x_{2-(p,\ q)}$, and the input signal value $x_{3-(p,\ q)}$, generates a pixel signal value $X_{1-(p,\ q)}$ of the first sub pixel used for determining the display gradation of the first sub pixel $\mathbf{49}R_{(p,\ q)}$, a pixel signal value $X_{2-(p,\ q)}$ of the second sub pixel used for determining the display gradation of the second sub pixel $\mathbf{49}G_{(p,\ q)}$, a pixel signal value $X_{3-(p,\ q)}$ of the third sub pixel used for determining the display gradation of the third sub pixel $\mathbf{49}B_{(p,\ q)}$, and a pixel signal value $X_{4-(p,\ q)}$ of the fourth sub pixel used for determining the display gradation of the fourth sub pixel $\mathbf{49}W_{(p,\ q)}$.

Figure 6:
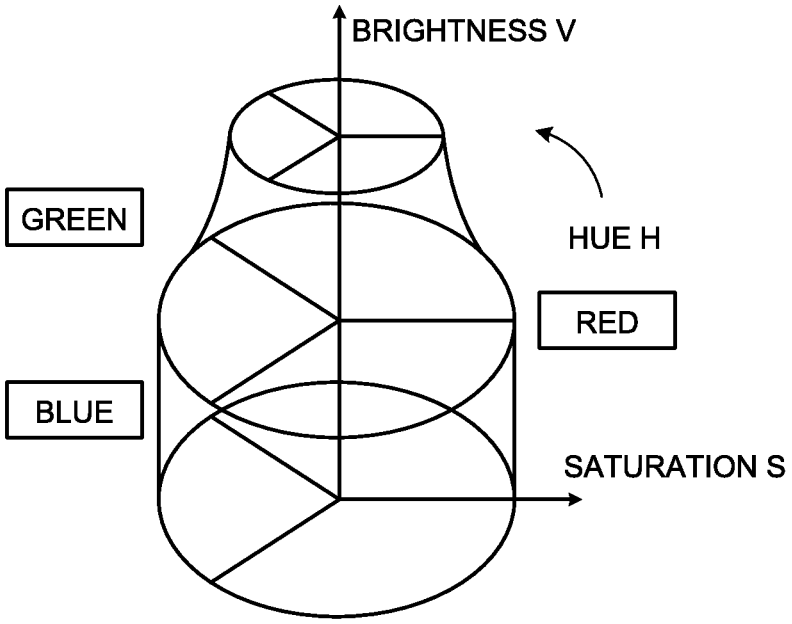
FIG. 6 is a conceptual diagram of an extended HSV color space that can be extended by the display device according to the first embodiment.
Figure 7:
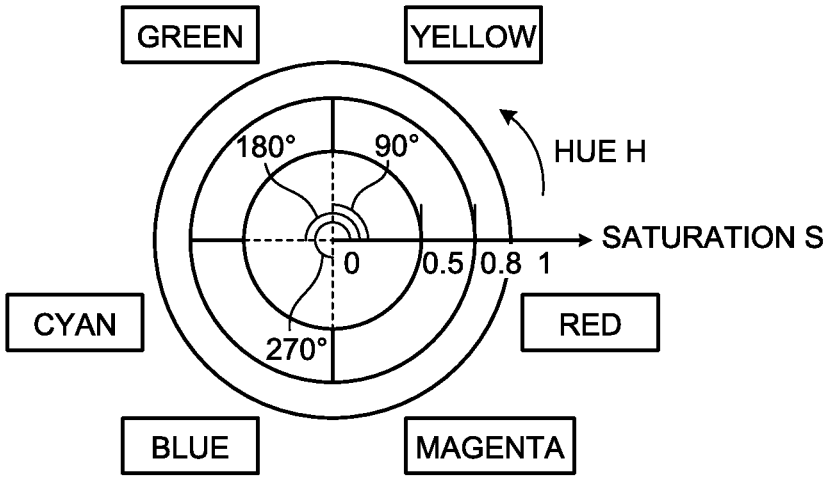
FIG. 7 is a conceptual diagram that illustrates a relation between the hue and the saturation of the extended HSV color space.

FIG. 6 is a conceptual diagram of an extended HSV color space that can be extended by the display device according to the first embodiment. FIG. 7 is a conceptual diagram that illustrates a relation between the hue and the saturation of the extended HSV color space. The display device 10, by including the fourth sub pixel 49W outputting the fourth color (white color) to the pixel 48, as illustrated in FIG. 6, broadens a dynamic range of brightness in an extended color space (in the first embodiment, the HSV color space). In other words, as illustrated in FIG. 6, the extended color space extended by the display device 10 has a shape in which, on a cylindrical color space that can be displayed by the first sub pixel 49R, the second sub pixel 49G, and the third sub pixel 49B, a three dimensional object having a shape in the cross-section including a saturation axis and a brightness axis to be an approximate trapezoid shape, of which the oblique side is a curve, having a maximum value of the brightness lowered as the saturation increases is placed. A maximum value Vmax(S) of the brightness having the saturation S in the extended color space (in the first embodiment, the HSV color space) extended by adding the fourth color (white color) as a variable is stored in the signal processor 20. In other words, the signal processor 20, for the three dimensional object of the extended color space illustrated in FIG. 6, stores a maximum value Vmax(S) of the brightness for each coordinate (value) of the saturation and the hue. Here, since an input signal is configured by input signals of the first sub pixel 49R, the second sub pixel 49G, and the third sub pixel 49B, the color space of the input signal has a cylindrical shape, in other words, has a same shape as a cylindrical portion of the extended color space. In the first embodiment, while the extended color space is described as the HSV color space, the extended color space is not limited thereto but may be an XYZ color space, a YUV space, or any other coordinate system.

First, the expansion coefficient calculating unit 70 acquires the saturation S and the brightness V(S) of each pixel 48 based on the input signal value (the input signal value $x_{1-(p,\ q)}$, the input signal value $x_{2-(p,\ q)}$, and the input signal value $x_{3-(p,\ q)}$) of each pixel 48, and calculates an expansion coefficient α for each pixel 48. The expansion coefficient α is set for each pixel 48. The hue H, as illustrated in FIG. 7, is represented from 0° to 360°. From 0° to 360°, red (Red), yellow (Yellow), green (Green), cyan (Cyan), blue (Blue), magenta (Magenta), and red are formed.

Generally, in a (p, q)-th pixel, the saturation (Saturation) $S_{(p,\ q)}$ and the brightness (Value) $V(S)_{(p,\ q)}$ of an input color in the HSV color space of the column can be acquired using the following Equation (1) and Equation (2) based on the input signal (the signal value $x_{1-(p,\ q)}$) of the first sub pixel, the input signal (the signal value $x_{2-(p,q)}$) of the second sub pixel, and the input signal (the signal value $x_{3-(p,\ q)}$) of the third sub pixel.

$$S_{(p,q)}=(\mathrm{Max}_{(p,q)}-\mathrm{Min}_{(p,q)})/\mathrm{Max}_{(p,q)} \tag{1}$$

$$V(S)_{(p,q)}=\mathrm{Max}_{(p,q)} \tag{2}$$

Here, $\mathrm{Max}_{(p,\ q)}$ is a maximum value of input signal values of three sub pixels 49 of ($x_{1-(p,\ q)}$, $x_{2-(p,\ q)}$, $x_{3-(p,\ q)}$), and $\mathrm{Min}_{(p,\ q)}$ is a minimum value of the input signal values of the three sub pixels 49 of ($x_{1-(p,\ q)}$, $x_{2-(p,\ q)}$, $x_{3-(p,\ q)}$). In the first embodiment, n=8. In other words, the number of display gradation bits is set as eight bits (the values of the display gradations are 256 gradations of 0 to 255).

The expansion coefficient calculating unit 70 calculates an expansion coefficient α by using the following Equation (3) based on the brightness $V(S)_{(p,\ q)}$ of each pixel 48 and Vmax(S) of the extended color space. There are cases where the expansion coefficient α has a different value for each pixel 48.

$$\alpha=V\mathrm{max}(S)/V(S)_{(p,q)} \tag{3}$$

Next, the output signal generating unit 72 calculates the pixel signal value $X_{4-(p,\ q)}$ of the fourth sub pixel based on at least the input signal (the signal value $x_{1-(p,\ q)}$) of the first sub pixel, the input signal (the signal value $x_{2-(p,\ q)}$) of the second sub pixel, and the input signal (the signal value $x_{3-(p,\ q)}$) of the third sub pixel. In more details, the output signal generating unit 72 acquires a pixel signal value $X_{4-(p,\ q)}$ of the fourth sub pixel based on a product of $\mathrm{Min}_{(p,\ q)}$ and the expansion coefficient α of the own pixel $48_{(p, q)}$. In more details, the output signal generating unit 72 can acquire the pixel signal value $X_{4-(p, q)}$ based on the following Equation (4). In Equation (4), while the product of $Min_{(p, q)}$ and the expansion coefficient $\alpha$ is divided by $\chi$, the equation is not limited thereto.

$$X_{4-(p,q)}=Min_{(p,q)}\cdot\alpha/\chi \quad (4)$$

Here, $\chi$ is a constant depending on the display device 10. In the fourth sub pixel 49W displaying the white color, a color filter is not arranged. The fourth sub pixel 49W displaying the fourth color, in the case of being emitted with a same light source lighting amount, is brighter than the first sub pixel 49R displaying the first color, the second sub pixel 49G displaying the second color, and the third sub pixel 49B displaying the third pixel. A case is considered when signals having values corresponding to the maximum signal values of the pixel signal values of the first sub pixel 49R, 49G, 49B are input to the first sub pixel 49R, the second sub pixel 49G, and the third sub pixel 49B respectively. In this case, the luminance of an aggregate of the first sub pixel 49R, the second sub pixel 49G, and the third sub pixel 49B included in a pixel 48 or a group of pixels 48 will be denoted by $BN_{1-3}$. In addition, it will be assumed that the luminance of the fourth sub pixel 49W at the time when a signal having a value corresponding to the maximum signal value of the pixel signal value of the fourth sub pixel 49W is input to the fourth sub pixel 49W included in a pixel 48 or a group of pixels 48 is $BN_4$. In other words, a white color having the maximum luminance is displayed by the aggregate of the first sub pixel 49R, the second sub pixel 49G, and the third sub pixel 49B, and the luminance of the white color is denoted by $BN_{1-3}$. Then, when $\chi$ is a constant depending on the display device 10, the constant $\chi$ is represented as $\chi=BN_4/BN_{1-3}$.

More specifically, when, as input signal values having values of the following display gradations, an input signal value $x_{1-(p, q)}=255$, an input signal value $x_{2-(p, q)}=255$, and an input signal value $x_{3-(p, q)}=255$ are input to the aggregate of the first sub pixel 49R, the second sub pixel 49G, and the third sub pixel 49B, the luminance $BN_4$ at the time when an input signal having a display gradation value of 255 is input to the fourth sub pixel 49W, for example, is 1.5 times of the luminance $BN_{1-3}$ of the white color. In other words, in the first embodiment, $\chi=1.5$.

Next, the output signal generating unit 72 calculates the pixel signal value $X_{1-(p, q)}$ of the first sub pixel based on at least the input signal value $x_{1-(p, q)}$ of the first sub pixel and the expansion coefficient $\alpha$ of the own pixel $48_{(p, q)}$, calculates the pixel signal value $X_{2-(p, q)}$ of the second sub pixel based on at least the input signal value $x_{2-(p, q)}$ of the second sub pixel and the expansion coefficient $\alpha$ of the own pixel $48_{(p, q)}$, and calculates the pixel signal value $x_{3-(p, q)}$ of the third sub pixel based on at least the input signal value $X_{3-(p, q)}$ of the third sub pixel and the expansion coefficient $\alpha$ of the own pixel $48_{(p, q)}$.

More specifically, the output signal generating unit 72 calculates the pixel signal value of the first sub pixel based on the input signal value of the first sub pixel, the expansion coefficient $\alpha$, and the pixel signal value of the fourth sub pixel, calculates the pixel signal value of the second sub pixel based on the input signal value of the second sub pixel, the expansion coefficient $\alpha$, and the pixel signal value of the fourth sub pixel, and calculates the pixel signal value of the third sub pixel based on the input signal value of the third sub pixel, the expansion coefficient $\alpha$, and the pixel signal value of the fourth sub pixel.

In other words, when $\chi$ is a constant depending on the display device, the output signal generating unit 72 acquires the pixel signal value $X_{1-(p, q)}$ of the first sub pixel, the pixel signal value $X_{2-(p, q)}$ of the second sub pixel, and the pixel signal value $X_{3-(p, q)}$ of the third sub pixel for the (p, q)-th pixel (or a set of the first sub pixel 49R, the second sub pixel 49G, and the third sub pixel 49B) by using the following Equations (5), (6), and (7).

$$X_{1-(p,q)}=\alpha\cdot x_{1-(p,q)}-\chi\cdot X_{4-(p,q)} \quad (5)$$

$$X_{2-(p,q)}=\alpha\cdot x_{2-(p,q)}-\chi\cdot X_{4-(p,q)} \quad (6)$$

$$X_{3-(p,q)}=\alpha\cdot x_{3-(p,q)}-\chi\cdot X_{4-(p,q)} \quad (7)$$

Next, the summary of a method (expansion process) for acquiring the signal values $X_{1-(p, q)}$, $X_{2-(p, q)}$, $X_{3-(p, q)}$, and $X_{4-(p, q)}$ will be described. The next process is performed such that the ratio among the luminance of a first primary color displayed by (the first sub pixel 49R+the fourth sub pixel 49W), the luminance of a second primary color displayed by (the second sub pixel 49G+the fourth sub pixel 49W), and the luminance of a third primary color displayed by (the third sub pixel 49B+the fourth sub pixel 49W) is maintained. In addition, the process is performed such that the color tone is maintained. Furthermore, the process is performed such that the gradation—luminance characteristics (a gamma characteristic and a $\gamma$ characteristic) are maintained. In addition, in one pixel 48 or a group of pixels 48, in a case where all the input signal values are zero or small, the expansion coefficient $\alpha$ may be acquired without including the pixel 48 or the group of pixels 48.

First Process

First, the expansion coefficient calculating unit 70 acquires the saturation S and the brightness V(S) of each pixel 48 based on the input signal values (the input signal value $x_{1-(p, q)}$, the input signal value $x_{2-(p, q)}$, and the input signal value $x_{3-(p, q)}$) of each pixel 48, and calculates an expansion coefficient $\alpha$ for each pixel 48.

Second Process

Next, the output signal generating unit 72 acquires the pixel signal value $X_{4-(p, q)}$ of the (p, q)-th pixel 48 based on at least the input signal value $x_{1-(p, q)}$, the input signal value $x_{2-(p, q)}$, and the input signal value $x_{3-(p, q)}$. In the first embodiment, the output signal generating unit 72 determines the pixel signal value $X_{4-(p, q)}$ based on $Min_{(p, q)}$, the expansion coefficient $\alpha$ of the own pixel $48_{(p, q)}$, and the constant $\chi$. More specifically, the output signal generating unit 72, as described above, acquires the pixel signal value $X_{4-(p, q)}$ based on Equation (4) described above.

Third Process

Thereafter, the output signal generating unit 72 acquires the pixel signal value $X_{1-(p, q)}$ of the (p, q)-th pixel 48 based on the input signal value $x_{1-(p, q)}$, the expansion coefficient $\alpha$ of the own pixel $48_{(p, q)}$, and the pixel signal value $X_{4-(p, q)}$, acquires the pixel signal value $X_{2-(p, q)}$ of the (p, q)-th pixel 48 based on the input signal value $x_{2-(p, q)}$, the expansion coefficient $\alpha$ of the own pixel $48_{(p, q)}$, and the pixel signal value $X_{4-(p, q)}$, and acquires the pixel signal value $X_{3-(p, q)}$ of the (p, q)-th pixel 48 based on the input signal value $x_{3-(p, q)}$, the expansion coefficient $\alpha$ of the own pixel $48_{(p, q)}$, and the pixel signal value $X_{4-(p, q)}$. More specifically, the output signal generating unit 72 acquires the pixel signal value $X_{1-(p, q)}$, the pixel signal value $X_{2-(p, q)}$, and the pixel signal value $X_{3-(p, q)}$ of the (p, q)-th pixel 48 based on Equations (5) to (7) described above.

The output signal generating unit 72 generates output signals through the process described above and outputs the generated output signal to the image display panel driving unit 30. As described above, in this embodiment, the pixel 48 has four sub pixels 49 and converts input signal of three colors into output signals of four colors. However, in the display device 10, the pixel 48, for example, may have only three sub pixels 49R, 49G, and 49B except for the fourth sub pixel 49W, and the display device 10 may convert input signals of three colors into output signals of three colors.

Process of Calculating Corrected Light Emission Value

Calculation of Light Emission Value

Next, the process of calculating a corrected light emission value and controlling the light emission amount of the light source unit 62 will be described. First, the light emission value calculating unit 74 acquires information of the expansion coefficient $\alpha$ of each pixel 48 from the expansion coefficient calculating unit 70. The light emission value calculating unit 74 calculates a light emission value $1/\alpha_0$ for each pixel 48 based on the expansion coefficient $\alpha$ of each pixel 48. The light emission value calculating unit 74 calculates a light emission value $1/\alpha_0$ for each of all the pixels 48 included in the image display panel 40. The value of the light emission value $1/\alpha_0$ of a certain pixel 48 is a reciprocal of the expansion coefficient $\alpha$ of the pixel 48. The light emission value calculating unit 74 calculates the light emission value $1/\alpha$ for each light source unit 62, in other words, for each partial area 126, based on the light emission value $1/\alpha_0$ of each pixel 48. More specifically, the light emission value calculating unit 74 sets the light emission value $1/\alpha_0$ of a pixel 48 having a maximum light emission value $1/\alpha_0$ among pixels 48 disposed inside a partial area 126 as a light emission value $1/\alpha$ for the partial area 126. In other words, the light emission value calculating unit 74 sets, as a light emission value $1/\alpha$ of the light source unit 62, the light emission value $1/\alpha_0$ of a pixel 48 having a maximum light emission value $1/\alpha_0$ among pixels 48 disposed inside a partial area 126 to which light is emitted by the light source unit 62.

The luminance calculating unit 76 calculates the luminance L of each pixel 48 based on an input signal of the pixel 48. The luminance calculating unit 76 calculates a luminance L for each of all the pixels 48 included in the image display panel 40. More specifically, the luminance calculating unit 76 calculates the luminance L of the pixel 48 based on the following Equation (8A).

$$L=0.299\cdot x_{1-(p,q)}+0.587\cdot x_{2-(p,q)}+0.114\cdot x_{3-(p,q)} \quad (8A)$$

However, Equation (8A) is an example. The luminance calculating unit 76 may calculate a luminance L by using another method as long as the method is based on the input signal value $x_{1-(p,\ q)}$ for the first sub pixel 49R, the input signal value $x_{2-(p,\ q)}$ for the second sub pixel 49G, and the input signal value $x_{3-(p,\ q)}$ for the third sub pixel 49B. For example, the luminance calculating unit 76 may calculate a luminance L based on the following Equation (8B).

$$L=0.2126\cdot x_{1-(p,q)}+0.7152\cdot x_{2-(p,q)}+0.0722\cdot x_{3-(p,q)} \quad (8B)$$

Chunk Detection

After the luminance L is calculated, the chunk determining unit 78 performs chunk detection. First, the chunk determining unit 78 performs a continuity determination. The chunk determining unit 78 selects a start point pixel 48*s* that is a start point for starting the continuity determination from among pixels 48 disposed inside the image display surface 41. The chunk determining umit 78 then performs continuity determinations for pixels 48 of sampling points extracted from among all the pixels 48 disposed inside the image display surface 41. The chunk determining unit 78 sequentially performs a continuity determination for each pixel 48 of the sampling points disposed on the determination direction Z side, from the start point pixel 48*s* along the determination direction Z. The chunk determining unit 78 determines an area of the pixels 48 determined to be continuous in the continuity determination as a chunk (chunk detection). The chunk determining unit 78 may perform chunk detection over the boundary of the area 124. In other words, the chunk determining unit 78 may determine pixels 48 belonging to mutually-different areas 124 to be continuous in the continuity determination. In such a case, the chunk is present over the mutually-different areas 124.

Here, the determination direction Z is the horizontal direction (X direction) and the vertical direction (Y direction), and the chunk determining unit 78 performs the continuity determination for each of the horizontal direction and the vertical direction. However, the chunk determining unit 78 may perform the continuity determination for only one of the horizontal direction and the vertical direction or may perform the continuity determination for a direction inclining from the horizontal direction or the vertical direction as the determination direction Z. Here, the horizontal direction is a direction in which a writing position at the time of writing an image on the image display panel 40 moves. In other words, a direction in which a pixel of which the signal is processed moves at the time of processing data is the horizontal direction. The vertical direction, as described above, is a direction orthogonal to the horizontal direction. In addition, the chunk determining unit 78, by analyzing pixels of the sampling points, the operation process can be reduced further than that of a case where all the pixels 48 are analyzed without acquiring sampling points. It is preferable that the sampling points are arranged at a predetermined pixel interval. The sampling points may deviate in the vertical direction or the horizontal direction or may be located at overlapping positions. The chunk determining unit 78 may perform the continuity determination for all the pixels 48 without acquiring sampling points.

Figure 8A:
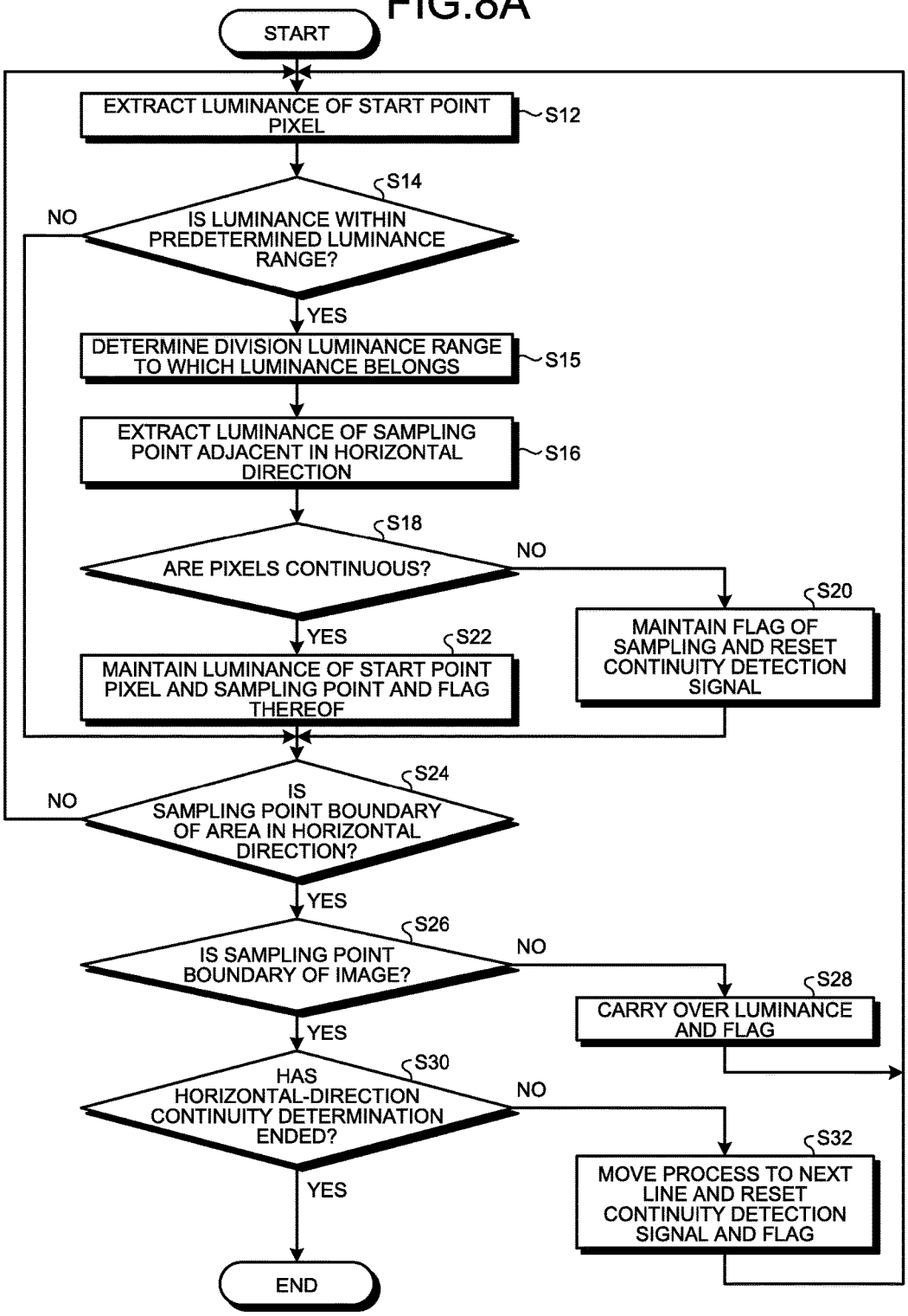
FIG. 8A is a flowchart that illustrates the processing flow of a continuity determination for the horizontal direction.

Hereinafter, the processing flow of the continuity determination, for example, for the horizontal direction will be described. FIG. 8A is a flowchart that illustrates the processing flow of a continuity determination for the horizontal direction. As illustrated in FIG. 8A, the chunk determining unit 78 extracts the luminance L of the start point pixel 48*s* (Step S12) and determines whether or not the luminance L of the start point pixel 48*s* is within a predetermined luminance range (Step S14). Here, a numerical range of the luminance can be taken by the pixel 48 is a value between a luminance lower limit value and a luminance upper limit value. The luminance lower limit value is a luminance value of a case where an input signal value of each sub pixel 49 is minimal and, in this embodiment, is a value of "0". The luminance upper limit value is a luminance of a case where the input signal value of each sub pixel is maximal and, in this embodiment, is a value of "255". Accordingly, in this embodiment, the numerical range of luminances can be taken by the pixel 48 is 0 to 255. The predetermined luminance range is a predetermined numerical range of luminances determined in advance and is a part of the numerical range of luminances can be taken by the pixel 48.

In this embodiment, in a case where the luminance L is lower than a threshold, the luminance L is determined to be outside the predetermined luminance range. In other words, the predetermined luminance range is equal to, or higher than the threshold. It is preferable that the threshold is a monochrome luminance upper limit value Ls1 or more and is a two-color luminance upper limit value Ls2 or less. The monochrome luminance upper limit value Ls1 is an upper limit value of the luminance that can be represented by a sub pixel 49 of single color (any one of the first sub pixel 49R, the second sub pixel 49G, and the third sub pixel 49B) among the sub pixels 49 of three colors (the first sub pixel 49R, the second sub pixel 49G, and the third sub pixel 49B). In addition, the two-color luminance upper limit value Ls2 is an upper limit value of the luminance that can be represented by sub pixels 49 of two colors (any two of the first sub pixel 49R, the second sub pixel 49G, and the third sub pixel 49B) among the sub pixels 49 of three colors. For example, according to Equation (8A), the monochrome luminance upper limit value Ls1 is "0.587×255", and the two-color luminance upper limit value Ls2 is "0.886×255". Here, 0.886 included in the two-color luminance upper limit value Ls2 is a value acquired by adding 0.299 to 0.587.

In a case where the luminance L of the start point pixel 48*s* is not within the predetermined luminance range (Step S14: No), the chunk determining unit 78 causes the process to proceed to Step S24.

On the other hand, in a case where the luminance L of the start point pixel 48*s* is determined to be within the predetermined luminance range (Step S14: Yes), the chunk determining unit 78 determines a division luminance range to which the luminance L of the start point pixel 48*s* belongs (Step S15). The chunk determining unit 78 classifies the predetermined luminance range into a plurality of division luminance ranges (classes). The chunk determining unit 78 determines a specific range among the plurality of division luminance ranges in which the luminance L of the start point pixel 48*s* is present.

FIG. 8B is a table that illustrates an example of luminance ranges. In the example illustrated in FIG. 8B, the chunk determining unit 78 stores division luminance ranges A to E. In the example illustrated in FIG. 8B, a division luminance range A has luminance of 236 to 255, a division luminance range B has luminance of 216 to 235, a division luminance range C has luminances of 196 to 215, a division luminance range D has luminances of 176 to 195, and a division luminance range E has luminances of 156 to 175. The chunk determining unit 78 compares the luminance L of the start point pixel 48*s* with each division luminance range and determines a division luminance range in which the luminance L of the start point pixel 48*s* is present. For example, in a case where the luminance L is 248, the chunk determining unit 78 determines that the luminance L belongs to the division luminance range A. In this example, while the lower limit value of the division luminance range E is 156, actually, the threshold described above corresponds to this lower limit value.

The chunk determining unit 78, after determining the division luminance range, extracts the luminance L of a sampling point adjacent in the horizontal direction of the start point pixel 48*s* (Step S16) and determines whether or not the pixel 48 of the sampling point is continuous from the start point pixel 48*s* (Step S18). In a case where the luminance L of the pixel 48 of the sampling point is within a predetermined luminance range, the chunk determining unit 78 determines that the pixels are continuous. In more details, in this embodiment, in a case where the luminance L of the pixel 48 of the sampling point is within a same division luminance range (in the example described above, the division luminance range A) as that of the start point pixel 48*s*, the chunk determining unit 78 determines that the pixels are continuous.

On the other hand, in a case where the pixels are determined not to be continuous (Step S18: No), the chunk determining unit 78 maintains a flag of the sampling, resets a continuity detection signal (Step S20), and causes the process to proceed to Step S24. The continuity detection signal is a signal that is in the ON state while the sampling point is continuous. On the other hand, in a case where the pixel is determined to be continuous (Step S18: Yes), the chunk determining unit 78 maintains the luminance L of the start point pixel 48*s* and the pixel 48 of the sampling point and the flag (Step S22) and causes the process to proceed to Step S24.

When the determination of the sampling point is performed, the chunk determining unit 78 determines whether or not the sampling point arrives at a boundary of an area in the horizontal direction (Step S24). In a case where the sampling point is determined not to have arrived at the boundary of the area in the horizontal direction (No in Step S24), the chunk determining unit 78 returns the process to Step S12 and performs a process similar to that described above for a next sampling point. In this way, the chunk determining unit 78 repeats the process until the sampling pixel arrives at the boundary of the area in the horizontal direction. On the other hand, in a case where the sampling point is determined to have arrived at the boundary of the area in the horizontal direction (Yes in Step S24), the chunk determining unit 78 determines whether or not the sampling point has arrived at a boundary of an image, in other words, a corner of pixels of the image display panel (Step S26).

In a case where the sampling point is determined not to have arrived at the boundary of an image (No in Step S26), the chunk determining unit 78 carries over the luminance L and the flag (Step S28) and returns the process to Step S22. On the other hand, in a case where the sampling point is determined to have arrived at the boundary of the image (Yes in Step S26), the chunk determining unit 78 determines whether the continuity determining process for the horizontal direction ends, in other words, whether the continuity determination has been performed for the sampling points of the all face of the image (Step S30).

In a case where the continuity determination for the horizontal direction is determined not to end (No in Step S30), the chunk determining unit 78 moves the process to a next line, resets the continuity detection signal and the flag (Step S32), and return the process to Step S12. On the other hand, in a case where the continuity determination for the horizontal direction is determined to end (Yes in Step S30), the chunk determining unit 78 ends this process.

Figure 8C:
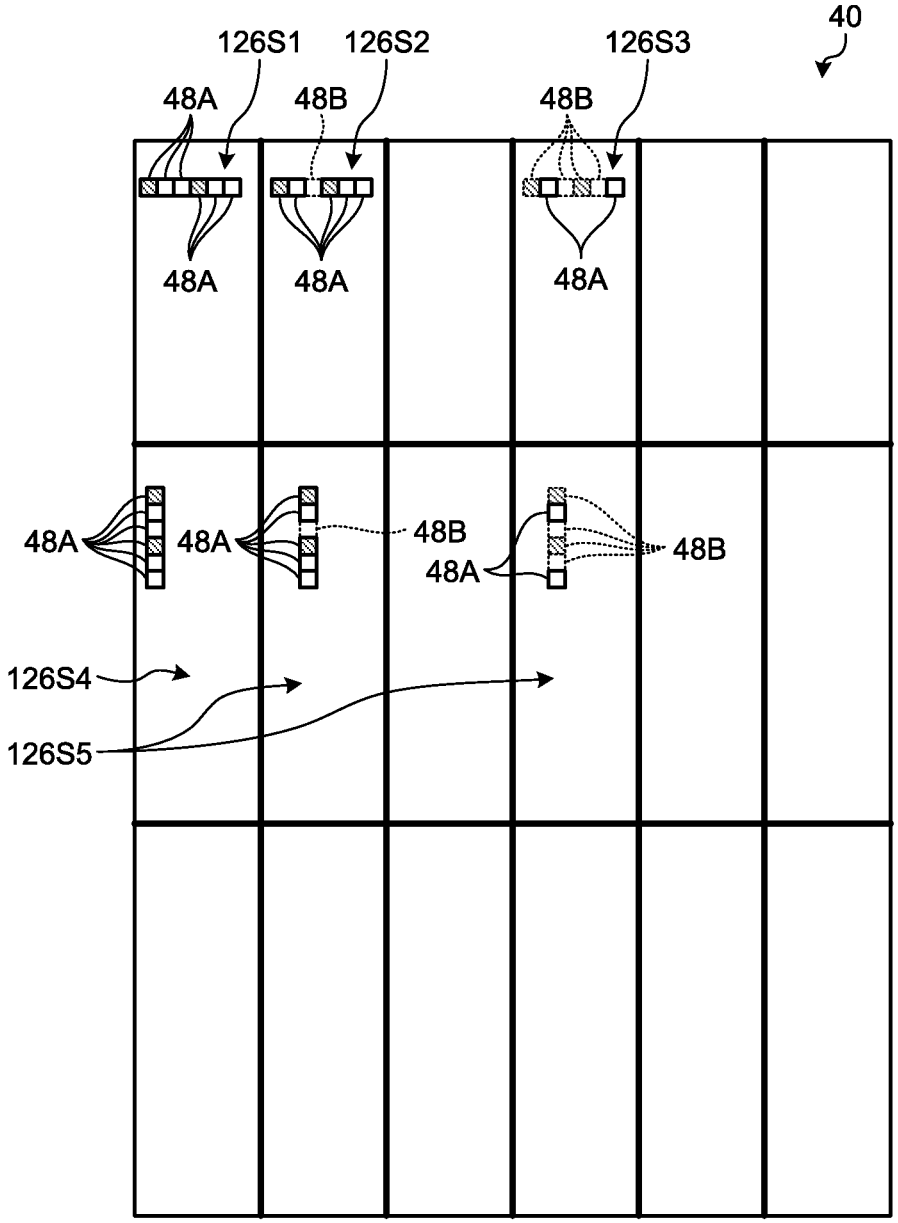
FIG. 8C is an explanatory diagram that is used for describing a chunk determining operation.

The processing flow of the continuity determination for the horizontal direction has been described as above. A continuity determination for the vertical direction is similarly performed, and thus, the description thereof will not be presented. The continuity determination for the vertical direction is performed in steps similar to those for the horizontal direction illustrated in FIG. 8A. The chunk determining unit 78, as described above, performs the continuity determination as described above and determines pixels up to a pixel 48 determined to be continuous as a chunk. Then, the chunk determining unit 78 sets a maximum luminance L0 among the luminances L of pixels 48 disposed inside the chunk as a luminance La of the chunk. FIG. 8C is an explanatory diagram that is used for describing a chunk determining operation. Pixels 48A illustrated in FIG. 8C are pixels having a luminance L to be within a predetermined luminance range and belonging to a same division luminance range. In addition, pixels 48B are pixels having luminances to be outside the predetermined luminance range or belonging to a division luminance range different from that of the pixels 48A. In the pixels 48A and 48B illustrated in FIG. 8C, pixels to which oblique lines are applied are pixels of sampling points. As illustrated in FIG. 8C, in each of partial areas 126S1 and 126S2, since pixels of sampling points are continuous in the horizontal direction (belonging to a same division luminance range), the continuous pixel group is determined as a chunk. However, in a partial area 126S3, since pixels of sampling points are not continuous in the horizontal direction, it is not determined that a chunk is present. Similarly, in each of partial areas 126S4 and 126S5, since pixels of sampling points are continuous in the vertical direction (belonging to a same division luminance range), the continuous pixel group is determined as a chunk. However, in a partial area 126S6, since pixels of sampling points are not continuous in the vertical direction, it is not determined that a chunk is present.

When the chunk detection for the whole image display surface 41 ends, the maximum luminance value detecting unit 80 detects a chunk having a maximum luminance La from among chunks disposed inside one partial area 126. The maximum luminance value detecting unit 80 detects the luminance La of the detected chunk as a maximum luminance value $L_{max1}$. The maximum luminance value detecting unit 80 detects a maximum luminance value $L_{max1}$ for each partial area 126.

Figure 9:
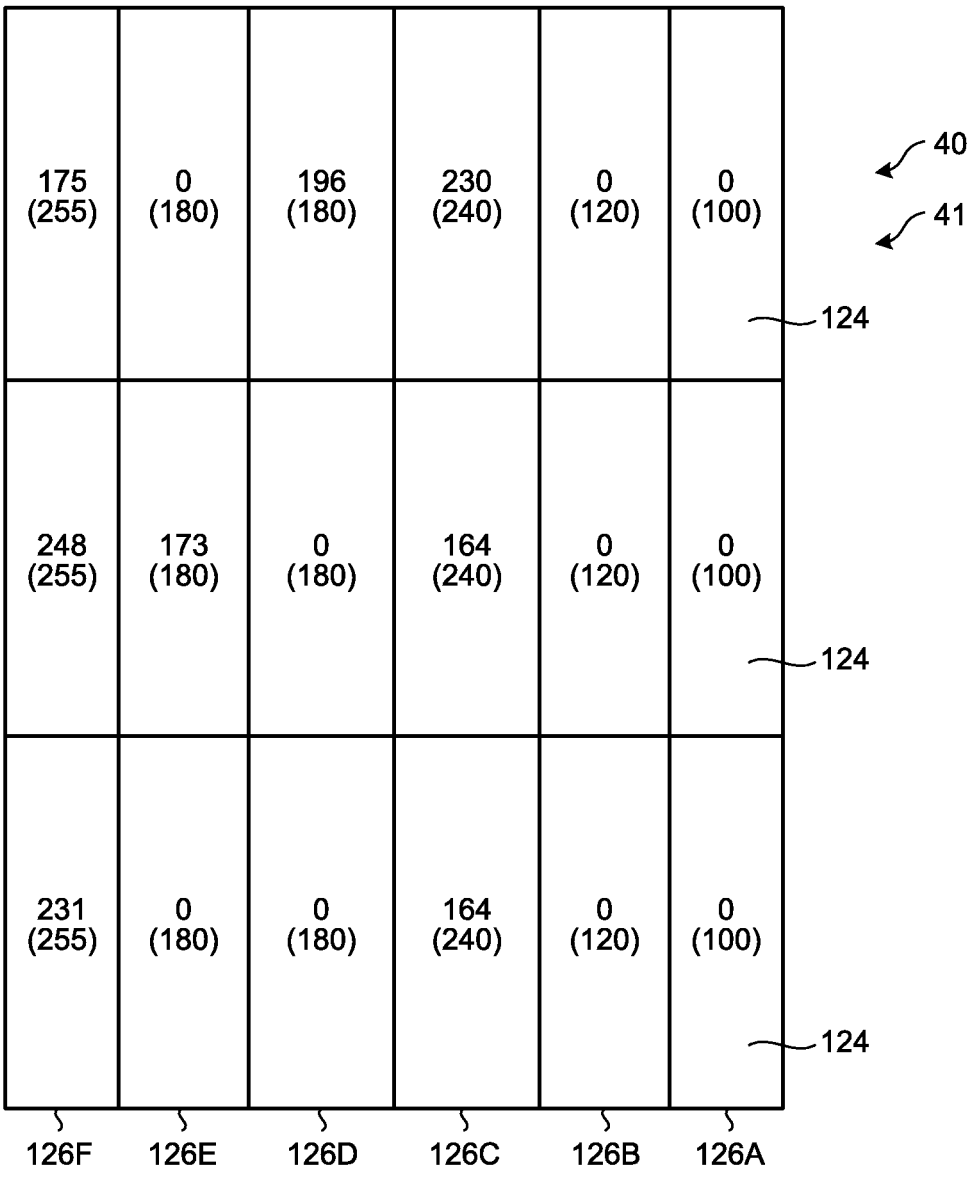
FIG. 9 is a diagram that illustrates an example of a maximum luminance value.

FIG. 9 is a diagram that illustrates an example of the maximum luminance value. FIG. 9 is a schematic diagram that illustrates the maximum luminance value $L_{maxi}$ of the inside of the image display surface 41. In FIG. 9, in a partial area 126A, it is represented that the luminance La of a chunk disposed inside each area 124 is "0". In other words, in the partial area 126A, no chunk is detected. In addition, in the partial area 126A, the light emission value is "100". In a partial area 126B, the light emission value is 120, and the luminance La of a chunk disposed inside each area 124 is "0". In addition, in a partial area 126C, the light emission value is 120, and the luminances La of chunks disposed in areas 124 are respectively 230, 164, and 164. In a partial area 126D, the light emission value is 180, and the luminances La of chunks disposed inside areas 124 are respectively 196, 0, and 0. In a partial area 126E, the light emission value is 180, and the luminances La of chunks disposed inside areas 124 are respectively 0, 173, and 0. In a partial area 126F, the light emission value is 255, and the luminances La of chunks disposed inside areas 124 are respectively 175, 248, and 231.

Accordingly, in the example illustrated in FIG. 9, the maximum luminance value detecting unit 80 sets the maximum luminance value $L_{max1}$ of the partial area 126C as 230, sets the maximum luminance value $L_{max1}$ of the partial area 126D as 196, sets the maximum luminance value $L_{max1}$ of the partial area 126E as 173, and sets the maximum luminance value $L_{max1}$ of the partial area 126F as 248

Luminance Gain Value Calculating Process

Next, the process of calculating a luminance gain value by using the luminance gain value determining unit 82 will be described. After the maximum luminance values $L_{max1}$ are calculated, the luminance gain value determining unit 82 detects an all-area maximum luminance value $L_{max2}$ that is a maximum luminance among the maximum luminance values $L_{max1}$ of all the partial areas 126 by using the all-area maximum luminance value calculating unit 90. In other words, the all-area maximum luminance value calculating unit 90 detects the maximum luminance value $L_{max1}$ of the maximum partial area 126M as the all-area maximum luminance value $L_{max2}$. In the example illustrated in FIG. 9, the maximum partial area 126M is the partial area 126F, and the all-area maximum luminance value $L_{max2}$ is 248.

After detecting the all-area maximum luminance value $L_{max2}$, the provisional luminance gain value calculating unit 92 calculates a provisional luminance gain value G1 for each partial area 126. First, the provisional luminance gain value calculating unit 92 calculates the provisional luminance gain value G1 of the maximum partial area 126M such that the provisional luminance gain value G1 of the maximum partial area 126M is a set gain value. The set gain value is a value acquired by adding 1.0 to a set raise value P. The set raise value P is a value set in advance and is preferably more than zero and 1.0 or less. In such a case, the set gain value is more than 1.0 and 2.0 or less. In the following example, the set raise value P will be described to be set as 0.5, and the set gain value will be described to be set as 1.5.

Then, the provisional luminance gain value calculating unit 92 calculates a provisional luminance gain value G1 for each partial area 126 such that the provisional luminance gain value G1 becomes smaller as the maximum luminance value $L_{max1}$ of the partial area 126 becomes smaller. In other words, the provisional luminance gain value G1 of the maximum partial area 126M has a set gain value having a maximum value, and the provisional luminance gain value G1 of any other partial area 126 has a smaller value as the maximum luminance value $L_{max1}$ is smaller. Accordingly, the provisional luminance gain values G1 of all the partial areas 126 are values that are the set gain value or less. More specifically, the provisional luminance gain value calculating unit 92 calculates a provisional luminance gain value G1 based on the following Equation (9).

$$G1=1.0+P\cdot L_{max1}/L_{max2} \tag{9}$$

In other words, the provisional luminance gain value calculating unit 92 calculates the ratio of a maximum luminance value $L_{max1}$ to the all-area maximum luminance value $L_{max2}$ for each partial area 126. The provisional luminance gain value calculating unit 92 calculates a provisional luminance gain value G1 based on this ratio and the set raise value P. In more details, the provisional luminance gain value calculating unit 92 calculates a provisional luminance gain value G1 by adding 1.0 to a raise term of multiplying the ratio by the set raise value P. The raise term is a term that contributes to an expanded amount in a case where the light emission value is assumed to be expanded by multiplying the light emission value by the provisional luminance gain value.

Figure 10:
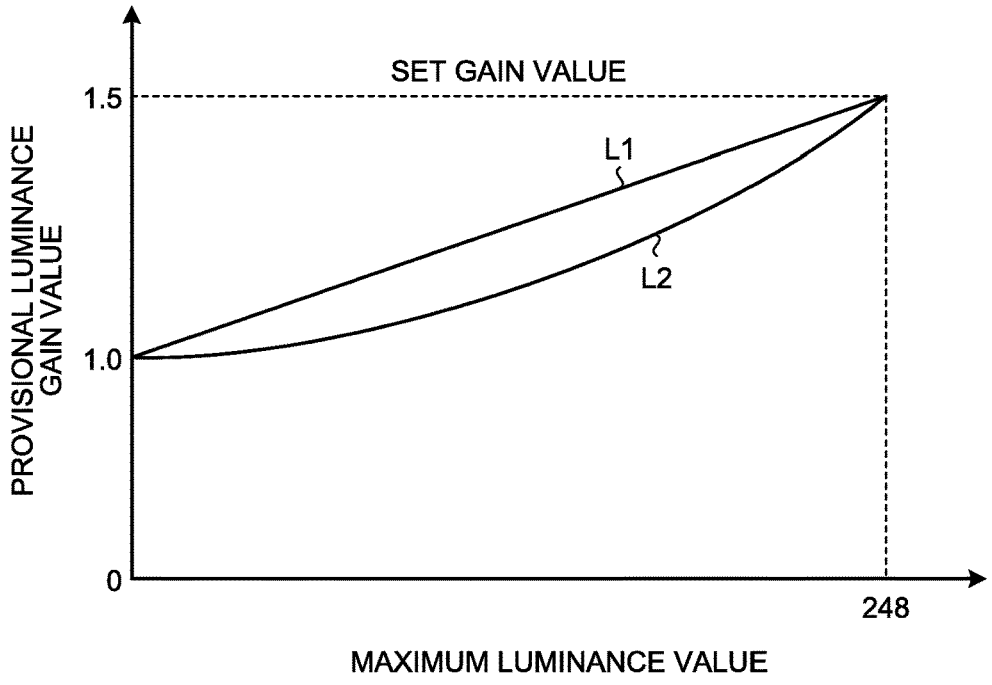
FIG. 10 is a graph that illustrates an example of a provisional luminance gain value.

FIG. 10 is a graph that illustrates an example of the provisional luminance gain value. In FIG. 10, the horizontal axis is the maximum luminance value, and the vertical axis is the provisional luminance gain value. A segment L1 illustrated in FIG. 10 illustrates a case where the provisional luminance gain value is calculated using Equation (9). As illustrated in the segment L1, the provisional luminance gain value G1 for a maximum luminance value $L_{max1}$ of 248, in other words, for the maximum partial area 126M, is 1.5 that is the same value as the set gain value. In addition, for a partial area 126 of which the maximum luminance value $L_{max1}$ is 0, the provisional luminance gain value G1 is 1, and the light emission value is not expanded.

However, the provisional luminance gain value G1 is not limited to linearly change in proportion to a change in the maximum luminance value $L_{max1}$ unlike Equation (9) and the segment L1 and, for example, as illustrated in a segment L2, may change in a curved shape in accordance with a change in the maximum luminance value $L_{max1}$.

After calculating the provisional luminance gain value, the provisional light emission value calculating unit 94, as represented in the following Equation (10), calculates a provisional light emission value $1/\alpha_1$ for each partial area 126 by multiplying the light emission value $1/\alpha$ by the provisional luminance gain value G1. The provisional light emission value $1/\alpha_1$ is acquired through multiplication using the provisional luminance gain value G1 and is a value of the light emission value $1/\alpha$ or more.

$$1/\alpha_1 = G1 \cdot (1/\alpha) \tag{10}$$

The corrected provisional luminance gain value calculating unit 96 calculates a corrected provisional luminance gain value G2 for each partial area 126, such that the corrected provisional luminance gain value G2 is a value of the provisional luminance gain value G1 of the same partial area 126 or less. The corrected provisional luminance gain value calculating unit 96 calculates a corrected provisional luminance gain value G2 based on the provisional light emission value $1/\alpha_1$ and an individual upper limit emission value $1/\alpha_{max1}$. More specifically, the corrected provisional luminance gain value calculating unit 96, as represented in Equation (11), calculates a ratio R1 of the provisional light emission value $1/\alpha_1$ to the individual upper limit emission value $1/\alpha_{max1}$ for each partial area 126. Then, the corrected provisional luminance gain value calculating unit 96 detects a maximum ratio R2 that is a maximum value within the ratio R1 of each partial area 126.

$$R1 = (1/\alpha_1)/(1/\alpha_{max1}) \tag{11}$$

Here, the individual upper limit emission value $1/\alpha_{max1}$, as described above, is an upper limit value of the emission amount of light that can be emitted by one light source unit 62. The individual upper limit emission value $1/\alpha_{max1}$ is a same (common) value for the light source units 62. If the individual upper limit emission value $1/\alpha_{max1}$ is 306, the ratio R1 for the partial area 126F (maximum partial area 126M) is 1.25 as maximum value. Accordingly, the maximum ratio R2 of this case is 1.25 that is the ratio R1 for the partial area 126F. In addition, in a case where all the ratios R1 are less than 1, the corrected provisional luminance gain value calculating unit 96 sets the maximum ratio R2 as 1.

Next, the corrected provisional luminance gain value calculating unit 96 calculates a corrected provisional luminance gain value G2 by correcting the provisional luminance gain value G1 by using this maximum ratio R2. In more details, the corrected provisional luminance gain value calculating unit 96, as represented in the following Equation (12), calculates a corrected provisional luminance gain value G2 by dividing the provisional luminance gain value G1 by the maximum ratio R2 for each partial area 126.

$$G2 = G1/R2 \tag{12}$$

The corrected provisional luminance gain value G2 is a value acquired by correcting the provisional luminance gain value G1 by using the maximum ratio R2 that is a maximum value of the ratio R1 of the provisional light emission value $1/\alpha_1$ to the individual upper limit emission value $1/\alpha_{max1}$. Since the maximum ratio R2 has a value of 1 or more, the corrected provisional luminance gain value G2 is a value of the provisional luminance gain value G1 or less for all the partial areas 126. In a case where the maximum ratio R2 is 1, in other words, in a case where the provisional light emission values $1/\alpha_1$ of all the partial areas 126 are values of the individual upper limit emission value $1/\alpha_{max1}$ or less, the corrected provisional luminance gain value calculating unit 96 sets the corrected provisional luminance gain value G2 as a same value as the provisional luminance gain value G1. On the other hand, in a case where the maximum ratio R2 is larger than 1, in other words, in a case where the provisional light emission value $1/\alpha_1$ for at least one partial area 126 is a value larger than the individual upper limit emission value $1/\alpha_{max1}$, the corrected provisional luminance gain value calculating unit 96 sets the corrected provisional luminance gain value G2 as a value smaller than the provisional luminance gain value G1.

In addition, a provisional light emission value (corrected provisional light emission value) calculated by multiplying the corrected provisional luminance gain value G2 by the light emission value $1/\alpha$ is a value of the provisional light emission value $1/\alpha_1$ for the same partial area 126 or less. In addition, this corrected provisional light emission value is a value of the individual upper limit emission value $1/\alpha_{max1}$ or less. In other words, it can be regarded that the corrected provisional luminance gain value calculating unit 96 calculates the corrected provisional luminance gain value G2 such that a value acquired by multiplying the light emission value $1/\alpha$ by the corrected provisional luminance gain value G2 is a value of the individual upper limit emission value $1/\alpha_{max1}$ or less.

Figure 11:
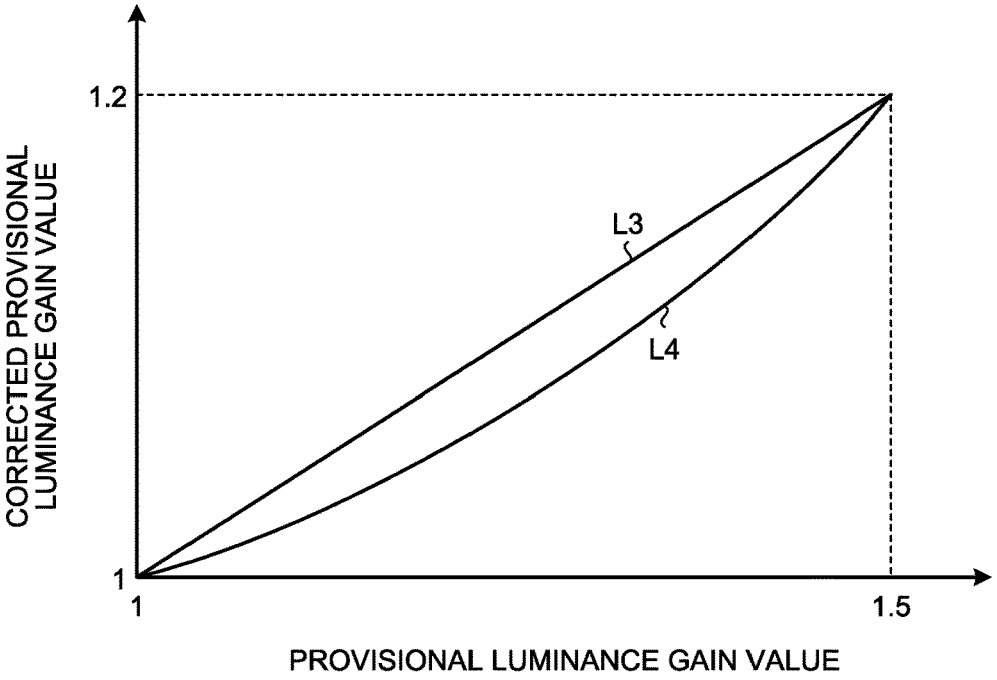
FIG. 11 is a graph that illustrates an example of a corrected provisional luminance gain value.

FIG. 11 is a graph that illustrates an example of the corrected provisional luminance gain value. In FIG. 11, the horizontal axis represents the provisional luminance gain value G1, and the vertical axis represents the corrected provisional luminance gain value G2. A segment L3 illustrated in FIG. 11 represents a case where the corrected provisional luminance gain value G2 is calculated as described above. As represented in the segment L3, the corrected provisional luminance gain value G2 for a provisional luminance gain value G1 of 1.5, in other words, for the partial area 126F (maximum partial area 126M) is 1.2 as a maximum. Then, the corrected provisional luminance gain value G2 decreases in proportion to a decrease rate of the provisional luminance gain value G1. Here, the corrected provisional luminance gain value G2, as represented in the segment L3, is not limited to linearly changing in proportion to a change in the provisional luminance gain value G1 and, for example, as represented in a segment L4, may change in a curved shape in accordance with a change in the provisional luminance gain value G1.

As above, after calculating the corrected provisional luminance gain value G2, the corrected provisional light emission value calculating unit 98 calculates a corrected provisional light emission value $1/\alpha_2$ for each partial area 126 by multiplying the light emission value $1/\alpha$ by the corrected provisional luminance gain value G2, as represented in the following Equation (13). The corrected provisional light emission value $1/\alpha_2$ is acquired through the multiplication using the corrected provisional luminance gain value G2 and thus is a value of the light emission value $1/\alpha$ or more.

$$1/\alpha_2 = G2 \cdot (1/\alpha) \tag{13}$$

Next, the luminance gain value calculating unit 99 calculates a luminance gain value G for each partial area 126 such that the luminance gain value G is a value of the corrected provisional luminance gain value G2 for the same partial area 126 or less. The luminance gain value calculating unit 99 calculates a luminance gain value G based on the corrected provisional light emission value $1/\alpha_2$ and a sum corrected provisional light emission value $1/\alpha_{2sum}$. More specifically, the luminance gain value calculating unit 99 calculates a sum corrected provisional light emission value $1/\alpha_{2sum}$ by summing the corrected provisional light emission values $1/\alpha_2$ of all the partial areas 126. The luminance gain value calculating unit 99, as represented in the following Equation (14), calculates a ratio R3 of the sum corrected provisional light emission value $1/\alpha_{2sum}$ to the sum upper limit emission value $1/\alpha_{max2}$.

$$R3=(1/\alpha_{2sum})/(1/\alpha_{max2}) \quad (14)$$

Here, the sum corrected provisional light emission value $1/\alpha_{2sum}$ is a sum value of corrected provisional light emission values $1/\alpha_2$ of all the partial areas 126. In addition, the sum upper limit emission value $1/\alpha_{max2}$, as described above, is an upper limit value of a sum of power consumption amounts of the light source units 62. Accordingly, the ratio R3 is one value that is common to all the partial areas 126. In a case where the ratio R3 is less than one, the luminance gain value calculating unit 99 sets the ratio R3 as 1.

Next, the luminance gain value calculating unit 99 calculates a luminance gain value G by correcting the corrected provisional luminance gain value G2 of each partial area 126 by using this ratio R3. More specifically, the corrected provisional luminance gain value calculating unit 96, as represented in the following Equation (15), calculates a luminance gain value G for each partial area 126 by dividing the corrected provisional luminance gain value G2 by the ratio R3 for each partial area 126.

$$G=G2/R3 \quad (15)$$

The luminance gain value G is a value acquired by correcting the corrected provisional luminance gain value G2 by using the ratio R3 of the sum corrected provisional light emission value $1/\alpha_{2sum}$ to the sum upper limit emission value $1/\alpha_{max2}$. Since this ratio R3 is a value of "1" or more, for all the partial areas 126, the luminance gain value G is a value of the corrected provisional luminance gain value G2 or less. In a case where the ratio R3 is "1" or less, in other words, in a case where the sum corrected provisional light emission value $1/\alpha_{2sum}$ is a value of the sum upper limit emission value $1/\alpha_{max2}$ or less, the luminance gain value calculating unit 99 sets the luminance gain value G as a same value as the corrected provisional luminance gain value G2. On the other hand, in a case where the ratio R3 is larger than "1", in other words, in a case where the sum corrected provisional light emission value $1/\alpha_{2sum}$ is a value larger than the sum upper limit emission value $1/\alpha_{max2}$, the luminance gain value calculating unit 99 sets the luminance gain value G as a value smaller than the corrected provisional luminance gain value G2.

In addition, a sum value of the corrected light emission values for all the partial areas 126 calculated by multiplying the light emission value $1/\alpha$ by the luminance gain value G is a value of the sum corrected provisional light emission value $1/\alpha_{2sum}$ or less. Then, a sum value of the corrected light emission values for all the partial areas 126 calculated by multiplying the light emission value $1/\alpha$ by the luminance gain value G is a value of the sum upper limit emission value $1/\alpha_{max2}$ or less. In other words, the luminance gain value calculating unit 99 calculates a luminance gain value G such that a sum value of values acquired by multiplying the light emission values $1/\alpha$ for the partial areas 126 by the luminance gain value G is a value of the sum upper limit emission value $1/\alpha_{max2}$ or less.

As above, the luminance gain value G is a value calculated by correcting the provisional luminance gain value G1 such that a value (corrected light emission value) acquired by multiplying the light emission value $1/\alpha$ by the luminance gain value G does not exceed the individual upper limit emission value $1/\alpha_{max1}$, and a sum value of corrected light emission values does not exceed the sum upper limit emission value $1/\alpha_{max2}$. Accordingly, the luminance gain value determining unit 82 determines a luminance gain value G for each partial area 126 based on the maximum luminance value $L_{max1}$ such that a value (corrected light emission value) acquired by multiplying the light emission value $1/\alpha$ by the luminance gain value G is a predetermined upper limit emission value or less. In addition, the luminance gain value determining unit 82 calculates a luminance gain value G by using the provisional luminance gain value G1 and thus sets the luminance gain value G to be larger as the partial area 126 has a higher maximum luminance value. Furthermore, the luminance gain value determining unit 82 calculates the luminance gain value G such that the corrected light emission value of each of a plurality of the partial areas 126 is a value of the individual upper limit emission value $1/\alpha_{max1}$ or less. In addition, the luminance gain value determining unit 82 calculates the luminance gain value G such that a sum value of corrected light emission values of all the partial areas 126 is a value of the sum upper limit emission value $1/\alpha_{max2}$ or less.

Process of Calculating Corrected Light Emission Amount

After the luminance gain value G is calculated as above, the light emission control unit 84, as in the following Equation (16), calculates a corrected light emission value $1/\alpha_M$ by multiplying the light emission value $1/\alpha$ by the luminance gain value G for each partial area 126. In other words, the corrected light emission value $1/\alpha_M$ is a value that is individually calculated for each light source unit 62. The corrected light emission value $1/\alpha_M$ is acquired through the multiplication using the luminance gain value G and thus is a value of the light emission value $1/\alpha$ or more.

$$1/\alpha_M=G\cdot(1/\alpha) \quad (16)$$

The light emission control unit 84 generates a planar light source device control signal SBL based on the corrected light emission value $1/\alpha_M$ and outputs the generated planar light source device control signal SBL to the light source driving unit 50. Accordingly, each light source unit 62 emits light toward each partial area 126 for an emission amount of light set as the corrected light emission value $1/\alpha_M$.

Figure 12:
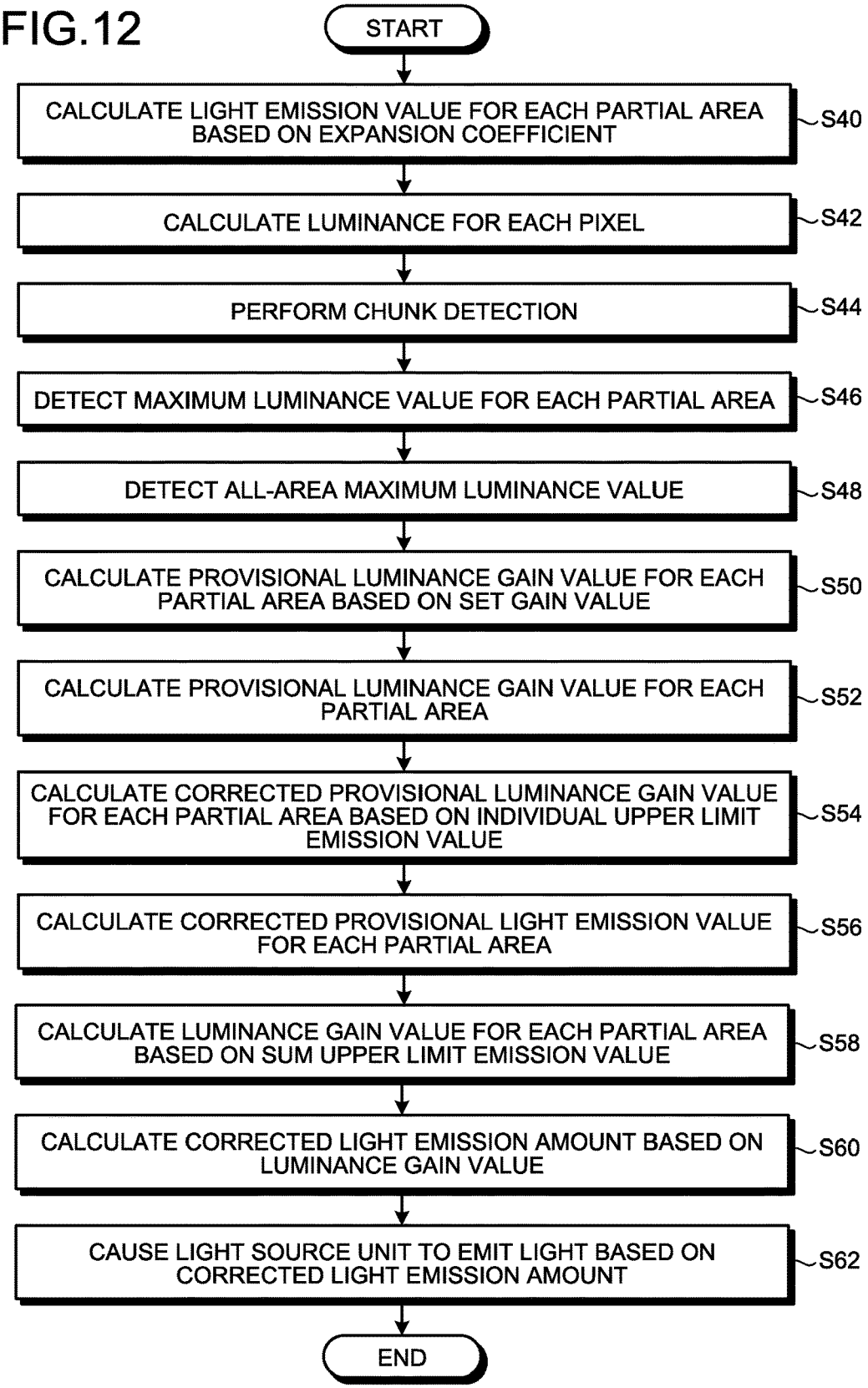
FIG. 12 is a flowchart that illustrates the processing flow of causing a light source unit to emit light.

Hereinafter, the processing flow of calculating a luminance gain value G and a corrected light emission value $1/\alpha_M$ and causing the light source unit 62 to emit light will be described with reference to a flowchart. FIG. 12 is a flowchart that illustrates the processing flow of causing a light source unit to emit light.

As illustrated in FIG. 12, the light emission value calculating unit 74 calculates a light emission value $1/\alpha$ based on the expansion coefficient $\alpha$ for each partial area 126 (Step S40). In addition, the luminance calculating unit 76 calculates a luminance L for each pixel 48 based on an input signal of each pixel 48 (Step S42). After the luminance L is calculated, the chunk determining unit 78 performs chunk detection (Step S44). In a case where pixels 48 present at adjacent samplings are within a same luminance range, the chunk determining unit 78 determines that the pixels 48 are continuous. The chunk determining unit 78 determines a group (pixel group) of pixels 48 determined to be continuous as a chunk (chunk detection). The chunk determining unit 78 detects a maximum luminance L0 among the luminances L of the pixels 48 inside the chunk as the luminance La of the chunk.

After the chunk detection is performed, the maximum luminance value detecting unit 80 detects a maximum luminance value $L_{max1}$ for each partial area 126 (Step S46). The maximum luminance value detecting unit 80 detects, as a maximum luminance value $L_{max1}$, the luminance La of a chunk having the luminance L to be maximal inside the partial area 126. After the maximum luminance value $L_{max1}$ is detected, the all-area maximum luminance value calculating unit 90 detects an all-area maximum luminance value $L_{max2}$ (Step S48). The all-area maximum luminance value calculating unit 90 detects a maximum luminance among maximum luminance values $L_{max1}$ of all the partial areas 126 as an all-area maximum luminance value $L_{max2}$.

After the all-area maximum luminance value $L_{max2}$ is detected, the provisional luminance gain value calculating unit 92 calculates a provisional luminance gain value G1 based on the set gain value for each partial area 126 (Step S50). More specifically, the provisional luminance gain value calculating unit 92 calculates the provisional luminance gain value G1 by using Equation (9) described above. After the provisional luminance gain value G1 is calculated, the provisional light emission value calculating unit 94 calculates a provisional light emission value $1/\alpha_1$ for each partial area 126 based on Equation (10) described above (Step S52).

After the provisional light emission value $1/\alpha_1$ is calculated, the corrected provisional luminance gain value calculating unit 96 calculates a corrected provisional luminance gain value G2 for each partial area 126 based on the individual upper limit emission value $1/\alpha_{max1}$ (Step S54). The corrected provisional luminance gain value calculating unit 96, by using Equations (11) and (12) described above, corrects the provisional luminance gain value G1 based on the provisional light emission value $1/\alpha_1$. The corrected provisional luminance gain value calculating unit 96 calculates a corrected provisional luminance gain value G2 such that a value acquired by multiplying the light emission value $1/\alpha$ by the corrected provisional luminance gain value G2 is a value of the individual upper limit emission value $1/\alpha_{max1}$ or less.

After the corrected provisional luminance gain value G2 is calculated, the corrected provisional light emission value calculating unit 98 calculates a corrected provisional light emission value $1/\alpha_2$ for each partial area 126 based on Equation (13) described above (Step S56). After the corrected provisional light emission value $1/\alpha_2$ is calculated, the luminance gain value calculating unit 99 calculates a luminance gain value G for each partial area 126 based on the sum upper limit emission value $1/\alpha_{max2}$ (Step S58). The luminance gain value calculating unit 99 corrects the corrected provisional luminance gain value G2 by using the corrected provisional light emission value $1/\alpha_2$ based on Equations (14) and (15) described above $1/\alpha_2$. The luminance gain value calculating unit 99 calculates a luminance gain value G such that a sum value of values acquired by multiplying the light emission value $1/\alpha$ by the luminance gain value G for each partial area 126 is a value of the sum upper limit emission value $1/\alpha_{max2}$ or less.

After the luminance gain value G is calculated, the light emission control unit 84 calculates a corrected light emission value $1/\alpha_M$ based on Equation (16) described above (Step S60) and causes the light source unit 62 to emit light based on the corrected light emission value $1/\alpha_M$ (Step S62). The light emission control unit 84 individually calculates a corrected light emission value $1/\alpha_M$ for each partial area 126, in other words, for each light source unit 62.

As described above, the display device 10 according to this embodiment includes the image display panel 40, a plurality of the light source units 62, and the signal processor 20. The light source units 62 are arranged in correspondence with a plurality of the partial areas 126 dividing the image display surface 41 of the image display panel 40 and emit light to corresponding partial areas 126. The signal processor 20 includes a light emission value calculating unit 74, a luminance calculating unit 76, a chunk determining unit 78, a maximum luminance value detecting unit 80, a luminance gain value determining unit 82, and a light emission control unit 84. The light emission value calculating unit 74 calculates a light emission value $1/\alpha$ for each of the plurality of the light source units 62, based on an input signal. The luminance calculating unit 76 calculates a luminance L of the pixel 48 based on an input signal. The chunk determining unit 78 determines whether pixels 48 within a predetermined range of luminance values (luminance range) among the plurality of pixels 48 are continuously present and determines an area (pixel group) of the continuous pixels 48 as a chunk. The maximum luminance value detecting unit 80 detects a maximum luminance value $L_{max1}$ having a maximum luminance among luminances La of pixels 48 disposed within a chunk in one partial area 126 for each partial area 126. The luminance gain value determining unit 82 determines a luminance gain value G for each partial area 126 based on the maximum luminance value $L_{max1}$, such that a corrected light emission value $1/\alpha_M$ is a value of a predetermined upper limit emission value set in advance or less. The corrected light emission value $1/\alpha_M$ is a value acquired by multiplying the light emission value $1/\alpha$ by the luminance gain value G. The light emission control unit 84 causes the plurality of the light source units 62 to emit light based on the corrected light emission value $1/\alpha_M$.

This display device 10 is a local dimming type capable of controlling an emission amount of light for each partial area 126. Accordingly, in a case where only a part of an image is displayed to be bright, by setting only an emission amount of light for a corresponding place to be large, the emission amount of light for the other places is suppressed, whereby the power consumption can be suppressed. However, in such a case, if a place to be displayed bright cannot be appropriately detected, there are cases where light is not appropriately emitted, and the display quality is degraded. However, this display device 10 calculates a maximum luminance value $L_{max1}$ from a chunk detected based on the luminances of the pixels 48. The display device 10 expands the light emission value $1/\alpha$ by using the luminance gain value G calculated based on the maximum luminance value $L_{max1}$ and causes the light source units 62 to emit light. In other words, the display device 10 detects a place (chunk) in which pixels 48 having high luminances L aggregate and can appropriate expand light to be emitted to the place. A place (a place to be displayed bright) in which pixels 48 having high luminances L aggregate can be visually recognized by a person more easily than a place in which such pixels 48 are present at separate points without aggregating. Accordingly, in a case where such a place cannot be displayed brighter, the degradation of the display quality can be visually recognized easily. However, this display device 10 performs chunk detection based on the luminances L, and accordingly, by appropriately increasing the light intensity of light to be emitted to a place having a high luminance and is visually distinguished, the degradation of the display quality can be suppressed. Accordingly, in a case where an image is displayed bright, this display device 10 can suppress degradation of the display quality while suppressing the power consumption.

In more details, this display device 10 detects a chunk based on the luminances L and thus can suppress degradation of the display quality more appropriately than in a case where a chunk is detected, for example, based on the light emission value $1/\alpha$. In a case where a chunk is detected based on the light emission value $1/\alpha$, there are cases where the value of the expansion coefficient $\alpha$ changes based on a result of the detection of a chunk. On the other hand, in a case where a chunk is detected based on the luminances L, the value of the light emission value $1/\alpha$ is not used, and accordingly, there is no influence of the result of chunk detection on the value of the expansion coefficient $\alpha$. In other words, in a case where an output signal is expanded by using the expansion coefficient $\alpha$, this display device 10 detects a chunk based on the luminances L and thus can appropriately increase the emission amount of light based on the chunk detection while maintaining the expansion coefficient $\alpha$ at an appropriate value. In other words, in a case where an output signal is expanded by using the expansion coefficient $\alpha$, this display device 10 can suppress degradation of the display quality more appropriately.

In addition, the display device 10 includes the fourth sub pixel 49W and outputs a color component, which can be represented by the fourth sub pixel 49W, of an input signal of three colors by using the fourth sub pixel 49W. A color displayed by the fourth sub pixel 49W is a color (here, a white color) having a luminance higher than those of the other three colors. Accordingly, the display device 10 decreases the light emission value $1/\alpha$, in other words, the emission amount of the light source unit 62 in correspondence with an increase of the output signal of the fourth sub pixel 49W. In other words, in a case where the output signal of the fourth sub pixel 49W is increased, a margin (room) for increasing the emission amount of the light source unit through chunk detection becomes high. Meanwhile, the display device 10 uses the value of the luminance L that is based on an input signal for the chunk detection. This luminance L depends on the color component of an input signal regardless of the light emission value $1/\alpha$. Accordingly, the display device 10 determines that the luminance L of a place in which the output signal of the fourth sub pixel 49W is increased to be high and increases the emission amount of light for the place. In other words, the display device 10 performs control such that the emission amount of light is increased for a place in which a margin for increasing the emission amount of the light source unit is high. Accordingly, in a case where the output signal of the fourth sub pixel 49W is generated, this display device 10 expands the luminance more appropriately and can appropriately suppress degradation of the display quality.

In addition, the luminance gain value determining unit 82 sets the luminance gain value G to be larger as the partial area 126 has a higher maximum luminance value $L_{max1}$. Accordingly, this display device 10 appropriately sets the emission amount of light to be larger as the area has a higher luminance of a chunk, and accordingly, degradation of the display quality can be suppressed more appropriately.

Furthermore, the luminance gain value determining unit 82 calculates a luminance gain value G such that a corrected light emission value $1/\alpha_M$ of each of the plurality of the partial areas 126 is a value of the individual upper limit emission value $1/\alpha_{max1}$ or less. The individual upper limit emission value $1/\alpha_{max1}$ is an upper limit value of the light intensity of light that can be emitted by each light source unit 62. This display device 10 sets the luminance gain value G such that all the corrected light emission values $1/\alpha_M$ do not exceed the individual upper limit emission value $1/\alpha_{max1}$. Accordingly, degradation of the display quality, for example, a collapsed view of the screen can be appropriately suppressed while the image is brightened up to near the individual upper limit emission value $1/\alpha_{max1}$.

In addition, the luminance gain value determining unit 82 calculates the luminance gain value G such that a sum value of the corrected light emission values $1/\alpha_M$ of all the partial areas 126 is a value of the sum upper limit emission value $1/\alpha_{max2}$ or less. The sum upper limit emission value $1\alpha_{max2}$ is a value that is based on an upper limit value of the power consumption amount that can be consumed by all the light source units 62. In a case where a sum value of the corrected light emission values $1/\alpha_M$ exceeds the sum upper limit emission value $1/\alpha_{max2}$, for example, emission at the light intensity set as the corrected light emission value $1/\alpha_M$ cannot be performed. Then there is concern that degradation of the display quality such as a collapsed view of the screen may occur. However, the display device 10 sets the luminance gain value G such that the sum value of the corrected light emission values $1/\alpha_M$ do not exceed the sum upper limit emission value $1/\alpha_{max2}$, and accordingly, degradation of the display quality can be suppressed more appropriately.

Furthermore, the luminance gain value determining unit 82 includes the all-area maximum luminance value calculating unit 90, the provisional luminance gain value calculating unit 92, the corrected provisional luminance gain value calculating unit 96, and the luminance gain value calculating unit 99. The all-area maximum luminance value calculating unit 90 detects an all-area maximum luminance value $L_{max2}$ among the maximum luminance values $L_{max1}$ of all the partial areas 126. The provisional luminance gain value calculating unit 92 calculates a provisional luminance gain value G1 for each partial area 126 such that the provisional luminance gain value G1 of the maximum partial area 126M is a set gain value, and the provisional luminance gain value G1 decreases as the partial area 126 has a smaller maximum luminance value $L_{max1}$. The corrected provisional luminance gain value calculating unit 96 calculates a corrected provisional luminance gain value G2 acquired by correcting the provisional luminance gain value G1 for each partial area 126, such that a value acquired by multiplying the light emission value $1/\alpha$ by the corrected provisional luminance gain value G2 is a value of the individual upper limit emission value $1/\alpha_{max1}$ or less. The luminance gain value calculating unit 99 calculates a luminance gain value G acquired by correcting the corrected provisional luminance gain value G2 for each partial area 126, such that a sum value of values acquired by multiplying the light emission values $1/\alpha$ by the luminance gain value G for each partial area 126 is a value of the sum upper limit emission value $1/\alpha_{max2}$ or less. This display device 10 calculates a luminance gain value G such that the corrected light emission value $1/a_M$ acquired by multiplying the light emission value $1/\alpha$ by the luminance gain value G does not exceed upper limit values such as the individual upper limit emission value $1/\alpha_{max1}$ and the sum upper limit emission value $1/\alpha_{max2}$. Accordingly, this display device 10 can suppress degradation of the display quality more appropriately.

Second Embodiment

Next, a second embodiment will be described. A display device 10*a* according to the second embodiment has a luminance gain value determining unit 82*a* different from that of the first embodiment. In the second embodiment, description of parts having common configurations to the first embodiment will not be presented.

Figure 13:
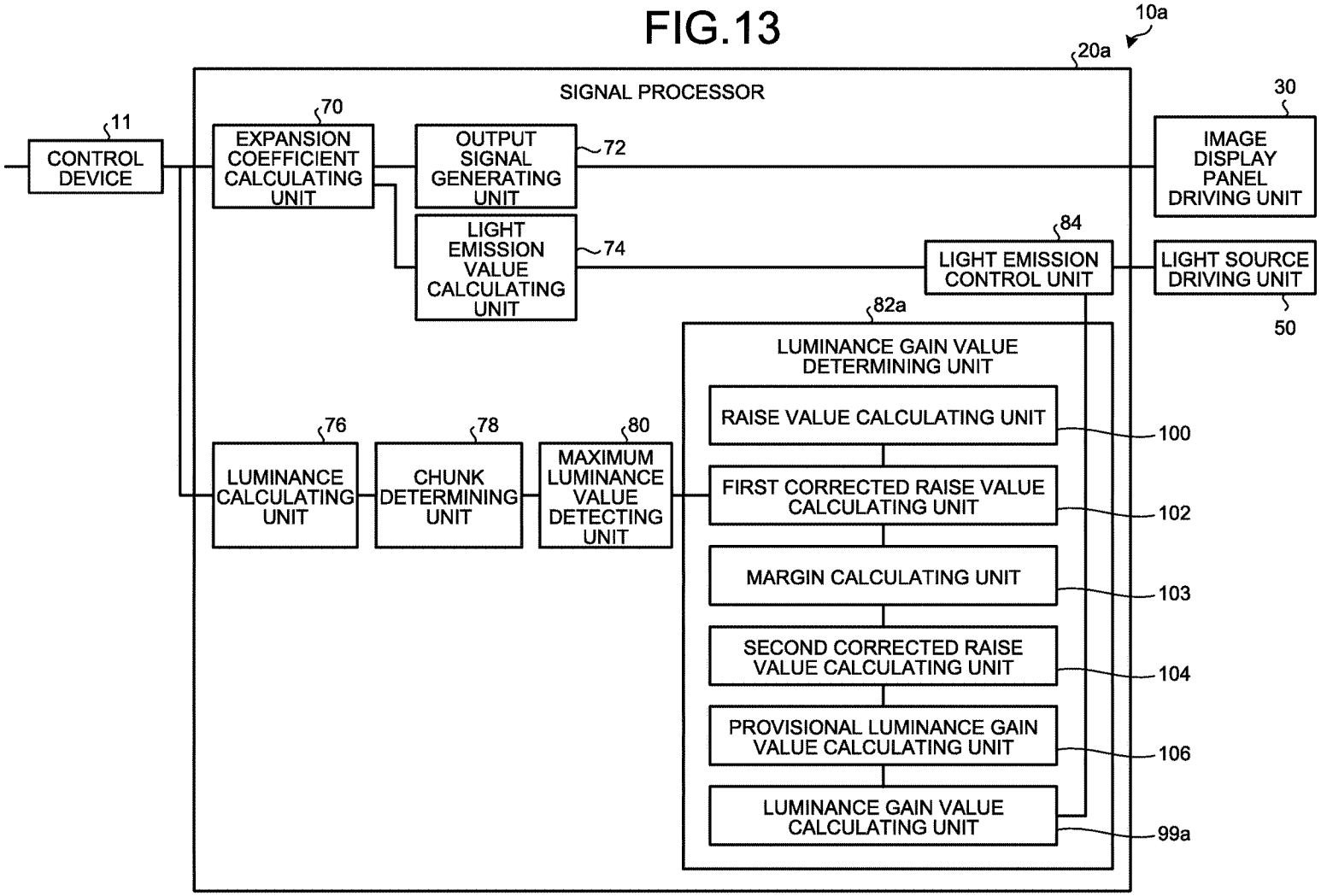
FIG. 13 is a block diagram that illustrates an overview of the configuration of a signal processor according to a second embodiment.

FIG. 13 is a block diagram that illustrates an overview of the configuration of a signal processor according to a second embodiment. As illustrated in FIG. 13, a signal processor

20*a* according to the second embodiment includes the luminance gain value determining unit 82*a*. The luminance gain value determining unit 82*a* includes: a raise value calculating unit 100; a first corrected raise value calculating unit 102; a margin calculating unit 103; a second corrected raise value calculating unit 104; a provisional luminance gain value calculating unit 106; and a luminance gain value calculating unit 99*a*. A control device 11, the signal processor 20*a*, and a light source driving unit 50 may be disposed inside a semiconductor integrated circuit of the display device 10*a*.

The raise value calculating unit 100 calculates a raise value Q0 for each partial area 126, the raise value Q0 is a value acquired by multiplying a light emission value $1/\alpha$ by a set raise value P. The set raise value P is the same as the set raise value P according to the first embodiment. The raise value calculating unit 100 calculates a raise value Q0 for each partial area 126 by using the common set raise value P.

The first corrected raise value calculating unit 102 calculates a first corrected raise value Q1 that is a value acquired by correcting the raise value Q0. The first corrected raise value calculating unit 102 calculates the first corrected raise value Q1 such that the first corrected raise value Q1 is a value of the raise value Q0 of the same partial area 126 or less. In addition, the first corrected raise value calculating unit 102 calculates the first corrected raise value Q1 for each partial area 126 such that the value is smaller as the partial area 126 has a smaller maximum luminance value $L_{max1}$.

The margin calculating unit 103 calculates a margin F. The margin F is a value acquired by subtracting a sum value $1/\alpha_{sum}$ of light emission values $1/\alpha$ for each partial area 126 from a sum upper limit emission value $1/\alpha_{max2}$.

The second corrected raise value calculating unit 104 calculates a second corrected raise value Q2 that is a value acquired by correcting the first corrected raise value Q1. The second corrected raise value calculating unit 104 calculates a second corrected raise value Q2 such that the second corrected raise value Q2 is a value of the first corrected raise value Q1 of the same partial area 126 or less. In more details, the second corrected raise value calculating unit 104 calculates the second corrected raise value Q2 for each partial area 126 such that a sum value of the second corrected raise values Q2 of all the partial areas 126 is a value of the margin F or less.

The provisional luminance gain value calculating unit 106 calculates a provisional luminance gain value G1a for each partial area 126. The provisional luminance gain value G1a is a value acquired by dividing a value acquired by adding the light emission amount $1/\alpha$ to the second corrected raise value Q2 by the light emission value $1/\alpha$.

The luminance gain value calculating unit 99*a* calculates a luminance gain value Ga that is a value acquired by correcting the provisional luminance gain value G1a. The luminance gain value calculating unit 99*a* calculates a luminance gain value Ga such that the luminance gain value Ga is a value of the provisional luminance gain value G1a of the same partial area 126 or less. In more details, the luminance gain value calculating unit 99*a* calculates a luminance gain value Ga for each partial area 126 such that a corrected light emission value $1/\alpha_M$ is a value of the individual upper limit emission value $1/\alpha_{max1}$ or less. The corrected light emission value $1/\alpha_M$ is a value acquired by multiplying the luminance gain value Ga by the light emission value $1/\alpha$.

Hereinafter, the process of calculating a luminance gain value Ga using the luminance gain value determining unit 82*a* will be described. The raise value calculating unit 100 calculates a raise value Q0 for each partial area 126. More specifically, the raise value calculating unit 100, as represented in the following Equation (17), calculates the raise value Q0 by multiplying the set raise value P by the light emission value $1/\alpha$. The raise value Q0 is a value of an emission amount corresponding to a raised (expanded) portion, in a case where the emission amount of light is raised up with a same ratio for all the partial areas 126 regardless of the luminance of a chunk of each partial area 126.

$$Q0=P\cdot(1/\alpha) \tag{17}$$

Next, the first corrected raise value calculating unit 102 calculates a first corrected raise value Q1. The first corrected raise value calculating unit 102 sets the first corrected raise value Q1 of the maximum partial area 126M as a same value as the raise value Q0 of the maximum partial area 126M. Then, the first corrected raise value calculating unit 102 calculates a first corrected raise value Q1 for each partial area 126 such that the first corrected raise value Q1 is smaller as the partial area 126 has a smaller maximum luminance value $L_{max1}$. Accordingly, the first corrected raise value Q1 of each of all the partial areas 126 is a value of the raise value Q0 or less. More specifically, the first corrected raise value calculating unit 102 calculates the first corrected raise value Q1 based on the following Equation (18).

$$Q1=Q0\cdot L_{max1}/L_{max2} \tag{18}$$

In other words, the first corrected raise value calculating unit 102 calculates a ratio of the maximum luminance value $L_{max1}$ to the all-area maximum luminance value $L_{max2}$ for each partial area 126. The first corrected raise value calculating unit 102 calculates a first corrected raise value Q1 for each partial area 126 based on this ratio corresponding to each partial area 126 and the raise value Q0.

The margin calculating unit 103, as represented in the following Equation (19), calculates a margin F by subtracting the sum value $1/\alpha_{sum}$ from the sum upper limit emission value $1/\alpha_{max2}$. The sum value $1/\alpha_{sum}$ is a value acquired by summing the light emission values $1/\alpha$ of all the partial areas 126. In other words, the margin F can be regarded as a margin of a sum value of light emission values $1/\alpha$ for all the partial areas 126 with respect to the sum upper limit emission value $1/\alpha_{max2}$. In other words, the margin F is a value by which the light emission value $1/\alpha$ can be raised (expanded).

$$F=(1/\alpha_{max2})-(1/\alpha_{sum}) \tag{19}$$

The second corrected raise value calculating unit 104 calculates a second corrected raise value Q2 for each partial area 126 such that the second corrected raise value Q2 is a value of the first corrected raise value Q1 of the same partial area 126 or less. The second corrected raise value calculating unit 104 calculates a second corrected raise value Q2 based on the first corrected raise value Q1 and the margin F. More specifically, the second corrected raise value calculating unit 104 calculates a sum first corrected raise value $Q1_{sum}$ that is a sum value of the first corrected raise values Q1 of all the partial areas 126. Then, the second corrected raise value calculating unit 104, as represented in the following Equation (20), calculates a ratio R4 of the sum first corrected raise value $Q1_{sum}$ to the margin F.

$$R4=Q1_{sum}/F \tag{20}$$

Here, the sum first corrected raise value $Q1_{sum}$ is a sum value for all the partial areas 126. In addition, the margin F is a value acquired by subtracting the sum value $1/\alpha_{sum}$ from the sum upper limit emission value $1/\alpha_{max2}$. Accordingly, the ratio R4 is one value that is common to all the partial areas 126. In a case where the ratio R4 is smaller than "1", the second corrected raise value calculating unit 104 sets the ratio R4 as "1".

The second corrected raise value calculating unit 104, as represented in the following Equation (21), calculates a second corrected raise value Q2 by dividing the first corrected raise value Q1 by the ratio R4.

$$Q2=Q1/R4 \tag{21}$$

Here, since the ratio R4 is a value of "1" or more, in all the partial areas 126, the second corrected raise value Q2 is a value of the first corrected raise value Q1 or less. In a case where the ratio R4 is "1", in other words, in a case where a sum value of the light emission values $1/\alpha$ is a value of the sum upper limit emission value $1/\alpha_{max2}$ or less (in a case where a margin for raising the light emission value $1/\alpha$ is zero or more), the second corrected raise value calculating unit 104 sets the second corrected raise value Q2 as a same value as the first corrected raise value Q1. On the other hand, in a case where the ratio R4 is larger than "1", in other words, in a case where a sum value of the light emission values $1/\alpha$ is a value larger than the sum upper limit emission value $1/\alpha_{max2}$, the second corrected raise value calculating unit 104 sets the second corrected raise value Q2 as a value smaller than the first corrected raise value Q1.

According to the process described above, the second corrected raise value calculating unit 104 calculates the second corrected raise value Q2 such that a sum value of the second corrected raise values Q2 of all the partial areas 126 is a value of the margin F or less.

The provisional luminance gain value calculating unit 106 calculates a provisional luminance gain value G1a for each partial area 126. More specifically, the provisional luminance gain value calculating unit 106 calculates a provisional light emission value $1/\alpha_{1a}$ for each partial area 126, the provisional light emission value $1/\alpha_{1a}$ is a value acquired by adding the light emission amount $1/\alpha$ to the second corrected raise value Q2. The provisional luminance gain value calculating unit 106, as represented in the following Equation (22), calculates a provisional luminance gain value G1a by dividing the provisional light emission value $1/\alpha_{1a}$ by the light emission value $1/\alpha$.

$$G1a=(1/\alpha_{1a})/(1/\alpha) \tag{22}$$

The luminance gain value calculating unit 99*a* calculates a luminance gain value Ga for each partial area 126 such that the luminance gain value Ga is a value of the provisional luminance gain value G1a of the same partial area 126 or less. The luminance gain value calculating unit 99*a* calculates the luminance gain value Ga based on the provisional light emission value $1/\alpha_{1a}$ and the individual upper limit emission value $1/\alpha_{max1}$. More specifically, the luminance gain value calculating unit 99*a*, as represented in Equation (23), calculates a ratio R5 for each partial area 126, the ratio R5 is a ratio of the provisional light emission value $1/\alpha_{1a}$ to the individual upper limit emission value $1/\alpha_{max1}$ for each partial area 126.

$$R5=(1/\alpha_{1a})/(1/\alpha_{max1}) \tag{23}$$

Then, the luminance gain value calculating unit 99*a* detects a maximum ratio R6 that is a maximum value among the ratios R5 of the partial areas 126. In a case where all the ratios R5 are smaller than "1", the luminance gain value calculating unit 99*a* sets the maximum ratio R6 as "1".

Next, the luminance gain value calculating unit 99*a* calculates a luminance gain value Ga by correcting the provisional luminance gain value G1a by using this maximum ratio R6. More specifically, the luminance gain value calculating unit 99*a*, as represented in Equation (24), calculates a luminance gain value Ga for each partial area 126, by dividing the provisional luminance gain value G1a by the maximum ratio R6.

$$Ga=G1a/R6 \tag{24}$$

Since the maximum ratio R6 is a value of "1" or more, in all the partial areas 126, the luminance gain value Ga is a value of the provisional luminance gain value G1a or less. In a case where the maximum ratio R6 is 1, in other words, in a case where the provisional light emission values $1/\alpha_{1a}$ of all the partial areas 126 are values of the individual upper limit emission value $1/\alpha_{max1}$ or less, the luminance gain value calculating unit 99*a* sets the luminance gain value Ga as a same value as the provisional luminance gain value G1a. On the other hand, in a case where the maximum ratio R6 is larger than "1", in other words, in a case where the provisional light emission value $1/\alpha_{1a}$ for at least one partial area 126 is a value larger than the individual upper limit emission value $1/\alpha_{max1}$, the luminance gain value calculating unit 99*a* sets the luminance gain value Ga as a value smaller than the provisional luminance gain value G1a.

In addition, a corrected light emission value calculated by multiplying the luminance gain value Ga by the light emission value $1/\alpha$ is a value of the provisional light emission value $1/\alpha_{1a}$ for the same partial area 126 or less. In addition, this corrected light emission value is a value of the individual upper limit emission value $1/\alpha_{max1}$ or less. In other words, it can be regarded that the luminance gain value calculating unit 99*a* calculates the luminance gain value Ga such that a value acquired by multiplying the luminance gain value Ga by the light emission value $1/\alpha$ is a value of the individual upper limit emission value $1/\alpha_{max1}$ or less.

The luminance gain value determining unit 82*a* calculates the luminance gain value Ga as above. Accordingly, the luminance gain value determining unit 82*a* determines a luminance gain value Ga for each partial area 126 based on the maximum luminance value $L_{max1}$, such that a value (corrected light emission value) acquired by multiplying the luminance gain value Ga by the light emission value $1/\alpha$ is a value of a predetermined upper limit emission value set in advance or less. In addition, the luminance gain value determining unit 82*a* sets the luminance gain value Ga to be larger as the partial area 126 has a higher maximum luminance value. In addition, the luminance gain value determining unit 82*a* calculates the luminance gain value Ga such that the corrected light emission value of each of the plurality of the partial areas 126 is a value of the individual upper limit emission value $1/\alpha_{max1}$ or less. Furthermore, the luminance gain value determining unit 82*a* calculates the luminance gain value Ga such that a sum value of the corrected light emission values of all the partial areas 126 is a value of the sum upper limit emission value $1/\alpha_{max2}$ or less.

Figure 14:
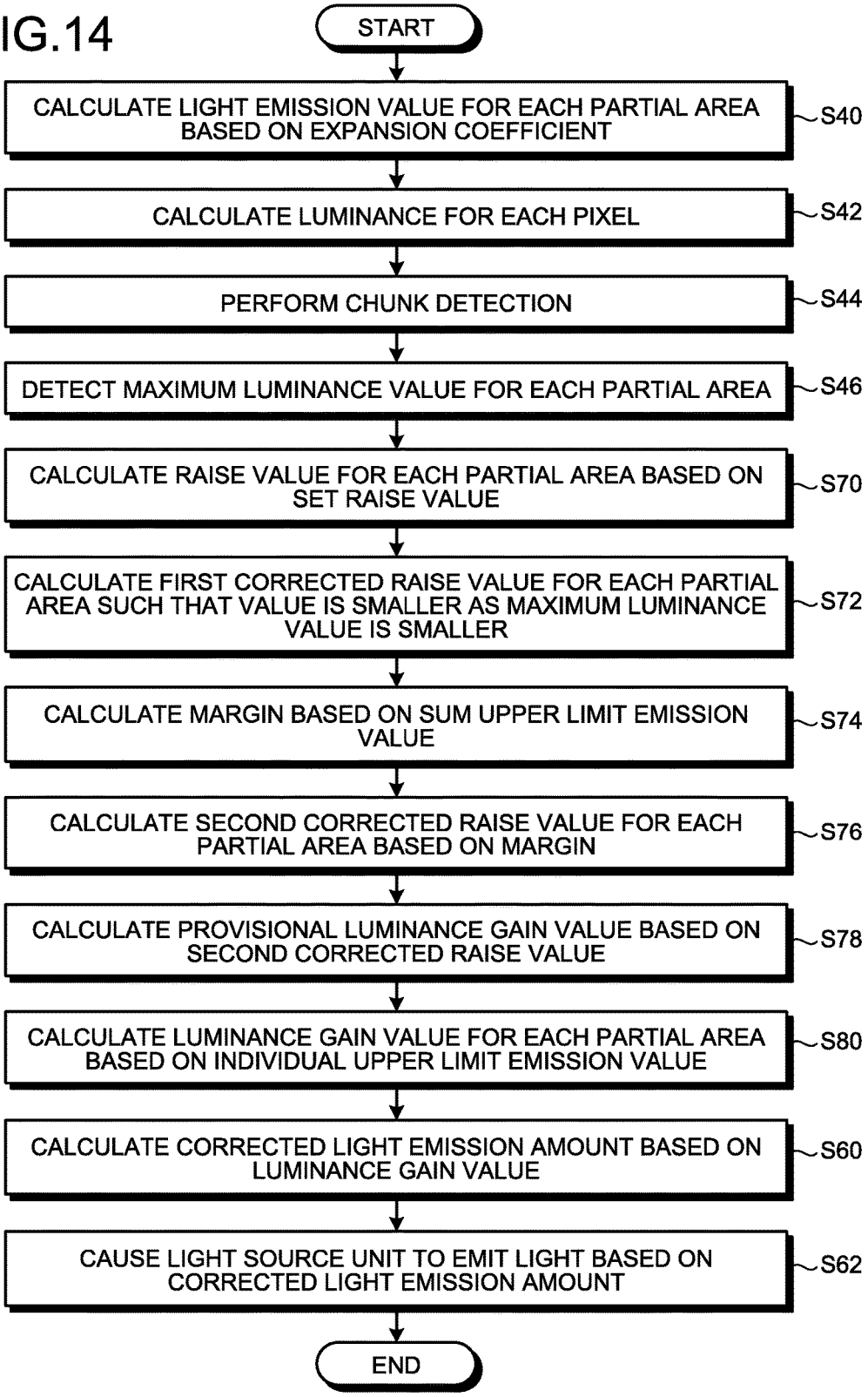
FIG. 14 is a flowchart that illustrates the processing flow of causing a light source unit to emit light.

Hereinafter, the processing flow of calculating a luminance gain value Ga and a corrected light emission value $1/\alpha_M$ and causing the light source unit 62 to emit light will be described with reference to a flowchart. FIG. 14 is a flowchart that illustrates the processing flow of causing a light source unit to emit light.

Step S40 to Step S46 illustrated in FIG. 14 are the same as those according to the first embodiment (FIG. 12). After Step S46, the raise value calculating unit 100 calculates a raise value Q0 for each partial area 126 based on the set raise value P (Step S70). After the calculation of the raise value Q0, the first corrected raise value calculating unit 102 calculates a first corrected raise value Q1 for each partial area 126 such that the value becomes smaller as the maximum luminance value $L_{max1}$ is smaller (Step S72). The first corrected raise value calculating unit 102 calculates a first corrected raise value Q1 based on Equation (18) described above. In addition, the margin calculating unit 103 calculates a margin F based on the sum upper limit emission value $1/\alpha_{max2}$ (Step S74). The margin calculating unit 103 calculates a margin F based on Equation (19) described above.

After the first corrected raise value Q1 and the margin F are calculated, the second corrected raise value calculating unit 104 calculates a second corrected raise value Q2 for each partial area 126 based on the margin F (Step S76). The second corrected raise value calculating unit 104 calculates a second corrected raise value Q2 based on Equation (20) and Equation (21) described above. After the calculation of the second corrected raise value Q2, the provisional luminance gain value calculating unit 106 calculates a provisional luminance gain value G1a for each partial area 126 based on the second corrected raise value Q2 (Step S78). The provisional luminance gain value calculating unit 106 calculates a provisional luminance gain value G1a based on Equation (22) described above.

Next, the luminance gain value calculating unit 99*a* calculates a luminance gain value Ga for each partial area 126 based on the individual upper limit emission value $1/\alpha_{max1}$ (Step S80). The luminance gain value calculating unit 99*a* calculates a luminance gain value Ga based on Equation (23) and Equation (24) described above. After Step S80, similar to the first embodiment, by performing Step S60 and Step S62, a corrected light emission value $1/\alpha_M$, and the light source units 62 are caused to emit light based on the corrected light emission value $1/\alpha_M$. In this way, the process ends.

As described above, the luminance gain value determining unit 82*a* according to the second embodiment includes: the raise value calculating unit 100; the first corrected raise value calculating unit 102; the margin calculating unit 103; the second corrected raise value calculating unit 104; the provisional luminance gain value calculating unit 106; and the luminance gain value calculating unit 99*a*. The raise value calculating unit 100 calculates a raise value Q0 for each partial area 126, the raise value Q0 is a value acquired by multiplying the light emission value $1/\alpha$ by the set raise value P. The first corrected raise value calculating unit 102 calculates a first corrected raise value Q1, which is a value acquired by correcting the raise value Q0, for each partial area 126 such that the value becomes smaller as the partial area 126 has a smaller maximum luminance value $L_{max1}$. The margin calculating unit 103 calculates a margin F that is a value acquired by subtracting the sum value $1/\alpha_{sum}$ from the sum upper limit emission value $1/\alpha_{max2}$. The second corrected raise value calculating unit 104 calculates a second corrected raise value Q2, which is a value acquired by correcting the first corrected raise value Q1, for each partial area 126 such that a sum value of the second corrected raise values Q2 of all the partial areas 126 is a value of the margin F or less. The provisional luminance gain value calculating unit 106 calculates a provisional luminance gain value G1a acquired by dividing a value, which is acquired by adding the light emission value $1/\alpha$ to the second corrected raise value Q2, by the light emission value $1/\alpha$ for each partial area 126. The luminance gain value calculating unit 99*a* calculates a luminance gain value Ga, which is a value acquired by correcting the provisional luminance gain value G1a, for each partial area 126 such that the corrected light emission value $1/\alpha_M$ is a value of the individual upper limit emission value $1/\alpha_{max1}$ or less.

The display device 10*a* according to the second embodiment calculates a luminance gain value Ga such that a corrected light emission value $1/\alpha_M$, which is acquired by multiplying the luminance gain value Ga by the light emission value $1/\alpha$, does not exceed upper limit values such as the individual upper limit emission value $1/\alpha_{max1}$ and the sum upper limit emission value $1/\alpha_{max2}$. Accordingly, this display device 10*a* can suppress degradation of the display quality more appropriately. In addition, the display device 10*a* calculates a margin F based on the sum upper limit emission value $1/\alpha_{max2}$ and sets a second corrected raise value Q2 such that a sum values of the second corrected raise values Q2 is a value of the margin F or less. Thereafter, the display device 10*a* sets a luminance gain value Ga such that the corrected light emission value $1/\alpha_M$ is a value of the individual upper limit emission value $1/\alpha_{max1}$ or less. In other words, the display device 10*a*, first, performs a process of causing a sum value of the corrected light emission values $1/\alpha_M$ not to exceed the sum upper limit emission value $1/\alpha_{max2}$ and, next, performs a process of causing the corrected light emission value $1/\alpha_M$ not to exceed the individual upper limit emission value $1/\alpha_{max1}$. In this way, the display device 10*a* can calculate the luminance gain value Ga more appropriately such that a sum value of the corrected light emission values $1/\alpha_M$ does not exceed the sum upper limit emission value $1/\alpha_{max2}$.

Third Embodiment

Next, a third embodiment will be described. In a display device 10*b* according to the third embodiment, a light emission value calculating unit is different from that of the first embodiment. In the third embodiment, description of parts common to the first embodiment will not be presented.

Figure 15A:
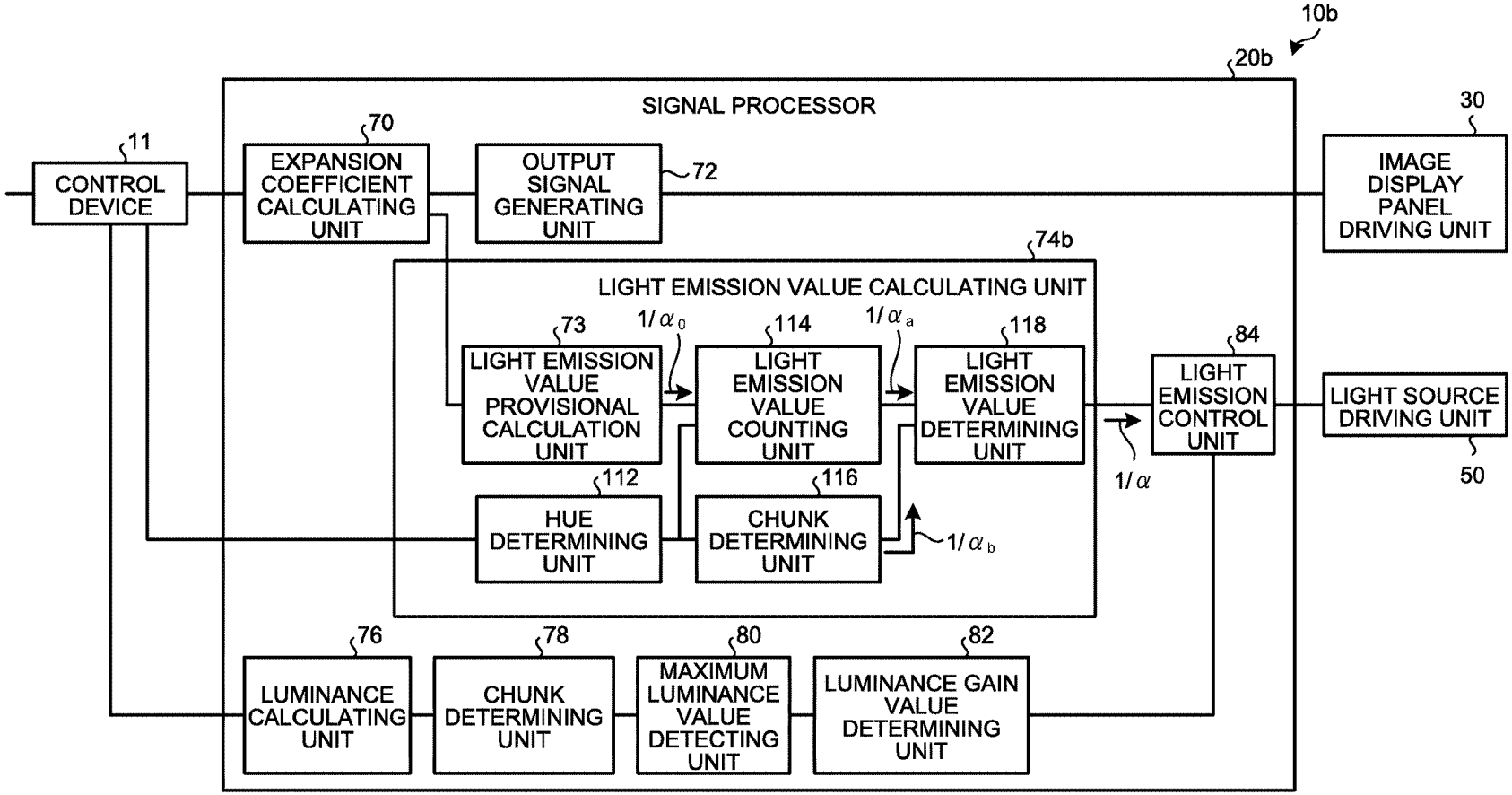
FIG. 15A is a block diagram that illustrates an overview of the configuration of a signal processor according to a third embodiment.

FIG. 15A is a block diagram that illustrates an overview of the configuration of a signal processor according to the third embodiment. As illustrated in FIG. 15A, a signal processor 20*b* according to the third embodiment includes a light emission value calculating unit 74*b*. The light emission value calculating unit 74*b* includes: a light emission value provisional calculation unit 73; a hue determining unit 112; a light emission value counting unit 114; a chunk determining unit 116; and a light emission value determining unit 118.

The light emission value provisional calculation unit 73 calculates a light emission value $1/\alpha_0$ for each pixel 48 by using a method similar to that for the light emission value $1/\alpha_0$ for each pixel 48 that is performed by the light emission value calculating unit 74 according to the first embodiment. The hue determining unit 112 determines the hue of each pixel based on an input signal or an output signal. The light emission value counting unit 114 calculates a light emission value $1/\alpha_a$ by processing a result calculated by the light emission value provisional calculation unit 73 and the hue calculated by the hue determining unit 112 by using a predetermined algorithm. Here, as the predetermined algorithm, for example, a process may be used in which a distribution of light emission values $1/\alpha_0$ inside the partial area 126 is calculated. The number of pixels 48 having a light emission value $1/\alpha_0$ is a predetermined number of pixels or more, and a highest light emission value $1/\alpha_0$ among them is set as a light emission value $1/\alpha_a$ of all the area that is common to one partial area 126. The light emission value counting unit 114 analyzes all the area of the partial areas 126 and calculates a light emission value $1/\alpha_a$ for all the area. The chunk determining unit 116 detects a chunk based on results acquired by the light emission value provisional calculation unit 73 and the hue determining unit 112, in other words, based on the light emission value $1/\alpha_0$ and the hue. The chunk determining unit 116 determines a light emission value $1/\alpha_b$ based on a result of the chunk detection. The chunk determining unit 116 performs the chunk detection based on the light emission value $1/\alpha_0$, which is different from the chunk determining unit 78.

The light emission value determining unit 118 determines a light emission value $1/\alpha$ of the partial area 126 based on a result (the light emission value $1/\alpha_a$ of all the areas) calculated by the light emission value counting unit 114 and a result (the light emission value $1/\alpha_b$ of a chunk) calculated by the chunk determining unit 116. In other words, in the third embodiment, the method of calculating the light emission value $1/\alpha$ is different from that of the first embodiment.

Figure 15B:
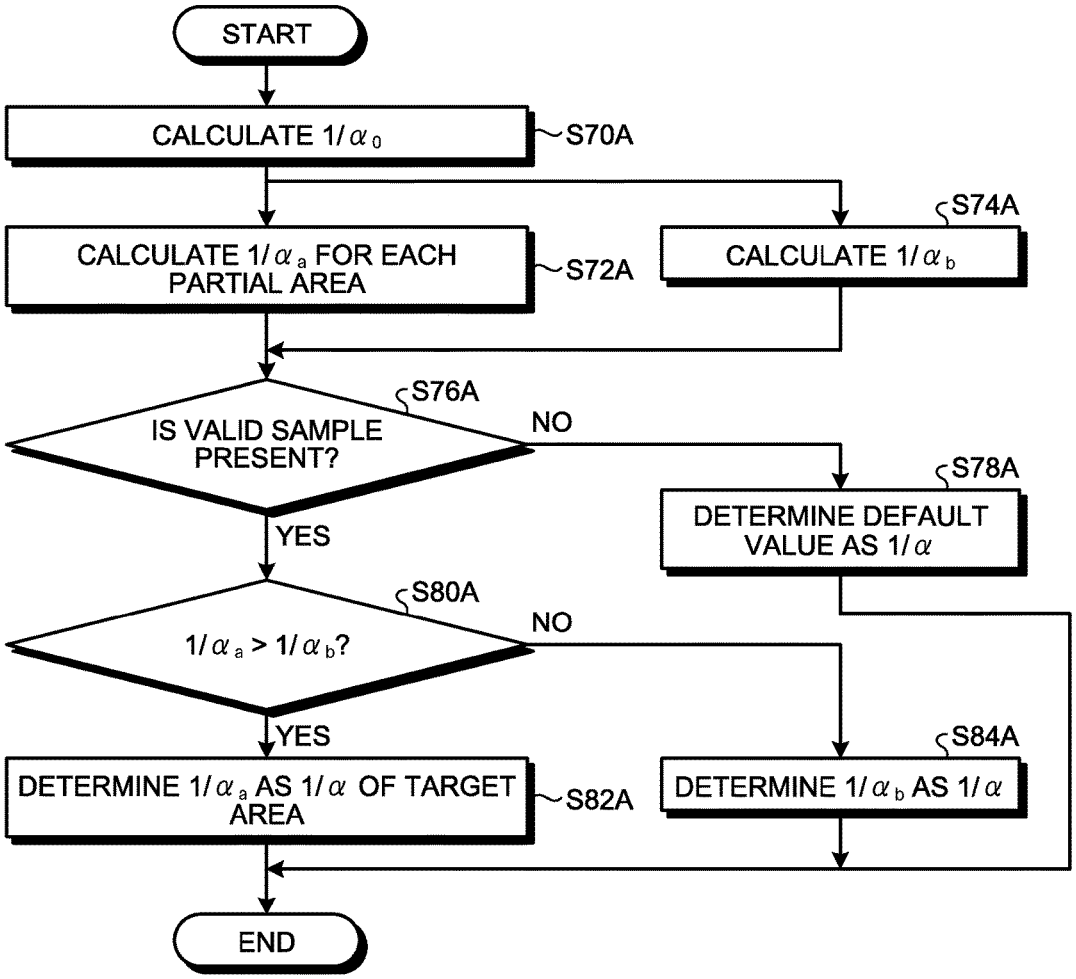
FIG. 15B is a flowchart that illustrates a process of calculating a light emission value according to the third embodiment.

Next, the process of calculating the light emission value $1/\alpha$ according to the third embodiment will be described in more detail. FIG. 15B is a flowchart that illustrates a process of calculating a light emission value according to the third embodiment. As illustrated in FIG. 15B, the light emission value calculating unit 74*b* detects (calculates) a light emission value $1/\alpha_0$ by using the light emission value provisional calculation unit 73 (Step S70A), and determines a light emission value $1/\alpha_b$ of a chunk by using the chunk determining unit 116 (Step S74A), while determining a light emission value $1/\alpha_a$ of all the area for each partial area 126 by using the light emission value counting unit 114 based on the calculated light emission value $1/\alpha_0$ of each pixel (Step S72A).

The light emission value counting unit 114 calculates a light emission value $1/\alpha_a$ of all the area by using a predetermined algorithm. More specifically, the light emission value counting unit 114 calculates a distribution of the light emission values $1/\alpha_0$ inside the partial area 126. The number of pixels 48 having a certain light emission value $1/\alpha_0$ is a predetermined pixel number or more, and a highest light emission value $1/\alpha_0$ among them is set as a light emission value $1/\alpha_a$ of all the area. The process of calculating the light emission value $1/\alpha_b$ of a chunk will be described later. Here, the process of Step S72A and the process of Step S74A may be performed parallel or sequentially.

When the light emission value $1/\alpha_a$ of all the area and the light emission value $1/\alpha_b$ of a chunk are determined, the light emission value calculating unit 74*b* determines whether a valid sample is present by using the light emission value determining unit 118 (Step S76A). Here, a valid sample is a pixel group determined to be continuous, in other words, a chunk among pixels of sampling points, and the absence of a valid sample represents a case where there are no pixels determined to be continuous, in other words, a case where a chunk is not detected. More specifically, the light emission value determining unit 118 determines whether the number of samples determined to be valid, in other words, a sampling number is larger than "0". In a case where it is determined that there is no valid sample (Step S76A: No), in other words, the valid sampling number is "0", the light emission value determining unit 118 determines a default value set in advance as the light emission value $1/\alpha$ (Step S78A) and ends this process. Here, as the default value, for example, 8'h20 can be used.

On the other hand, in a case where it is determined that there is a valid sample (Step S76A: Yes), in other words, the valid sampling number is one or more, the light emission value determining unit 118 determines whether the light emission value $1/\alpha_a$ of all the area>the light emission value $1/\alpha_b$ of a chunk (Step S80A). In a case where it is determined that the light emission value $1/\alpha_a$ of all the area>the light emission value $1/\alpha_b$ of a chunk (Step S80A: Yes), the light emission value determining unit 118 determines the light emission value $1/\alpha_a$ of all the area as the light emission value $1/\alpha$ (Step S82A) and ends this process. On the other hand, in a case where it is determined that the light emission value $1/\alpha_a$ of all the area≤the light emission value $1/\alpha_b$ of a chunk (Step S80A: No), the light emission value determining unit 118 determines the light emission value $1/\alpha_b$ of the chunk as the light emission value $1/\alpha$ (Step S84A) and ends this process. In other words, the light emission value determining unit 118 sets a larger value as the light emission value $1/\alpha$.

Here, the method of calculating the light emission value $1/\alpha_b$ of a chunk will be described. When the light emission value $1/\alpha_b$ of a chunk is calculated, the chunk determining unit 116 performs chunk detection in the horizontal direction by using a method (see FIG. 8A) similar to that of the chunk determining unit 78 by using the light emission value $1/\alpha_0$ instead of the luminance L of a pixel. In other words, in a case where the start point pixel 48*s* and pixels 48 of sampling points belong to a numerical range of a same light emission value $1/\alpha_0$, the chunk determining unit 116 determines that such pixels 48 are continuous and determines the continuous pixels as a chunk. The chunk detection in the vertical direction is similar to that in the horizontal direction. The chunk determining unit 116, for example, sets the light emission value $1/\alpha_0$ of the pixel 48 having a maximum light emission value $1/\alpha_0$ among pixels 48 determined to be a chunk in the horizontal direction as the light emission value $1/\alpha_b$ of the chunk in the horizontal direction. Similarly, the chunk determining unit 116, for example, sets the light emission value $1/\alpha_0$ of the pixel 48 having a maximum light emission value $1/\alpha_0$ among the pixels 48 determined to be a chunk in the vertical direction as the light emission value $1/\alpha_b$ of the chunk in the vertical direction.

Figure 15C:
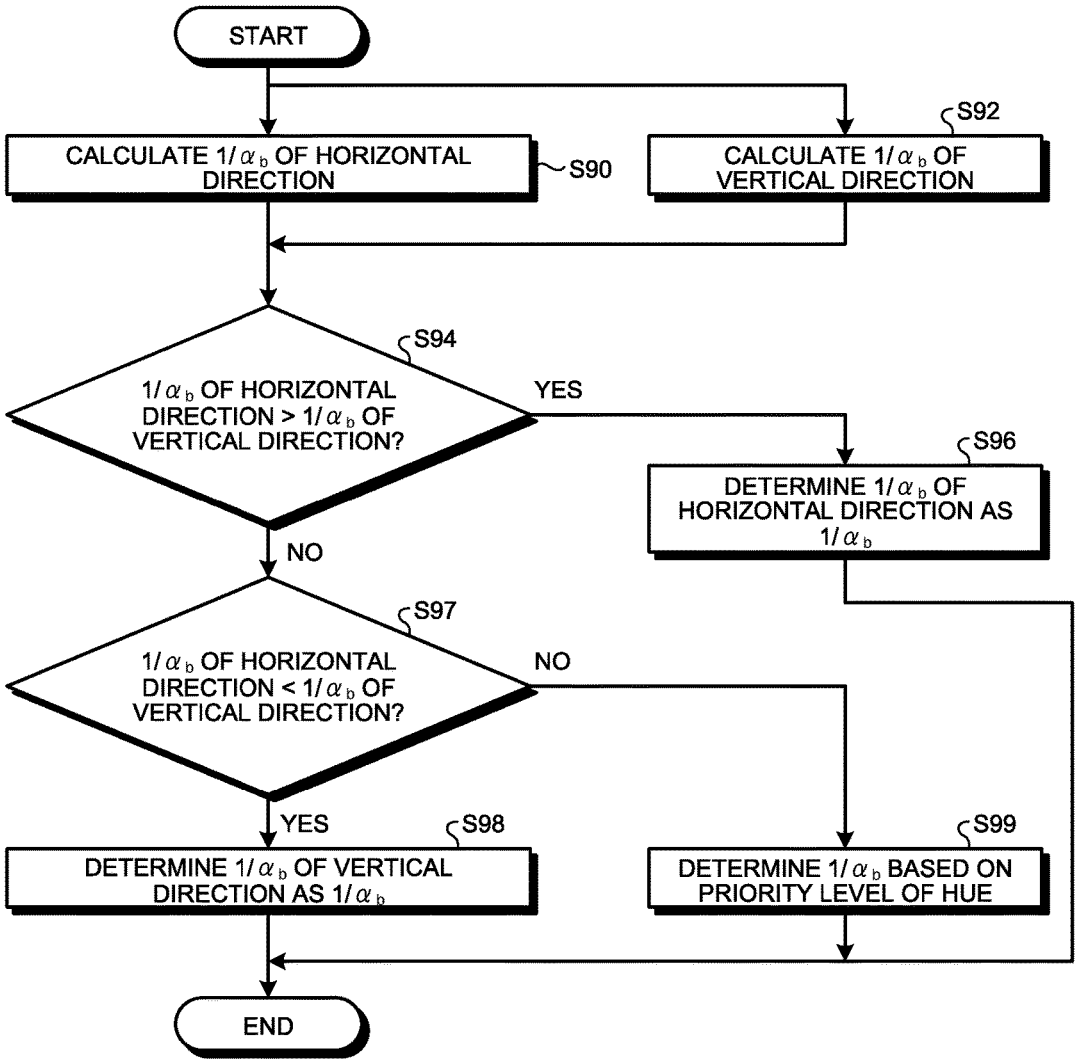
FIG. 15C is a flowchart that illustrates a method of calculating a light emission value of a chunk according to the third embodiment.

FIG. 15C is a flowchart that illustrates a method of calculating a light emission value of a chunk according to the third embodiment. As illustrated in FIG. 15C, first, the chunk determining unit 116 calculates $1/\alpha_b$ of a chunk in the vertical direction (Step S92) while calculating $1/\alpha_b$ of a chunk in the horizontal direction based on $1/\alpha_0$ of each pixel (Step S90). Here, the process of Step S90 and the process of Step S92 may be performed parallel or sequentially.

After $1/\alpha_b$ of a chunk in the horizontal direction and the vertical direction are calculated, the chunk determining unit 116 determines whether $1/\alpha_b$ of the chunk in the horizontal direction $>1/\alpha_b$ of the chunk in the vertical direction (Step S94). In a case where it is determined that $1/\alpha_b$ of the chunk in the horizontal direction $>1/\alpha_b$ of the chunk in the vertical direction (Step S94: Yes), the chunk determining unit 116 determines $1/\alpha_b$ of the chunk in the horizontal direction as $1/\alpha_b$ of the chunk (Step S96) and ends this process. On the other hand, in a case where it is not determined that $1/\alpha_b$ of the chunk in the horizontal direction $>1/\alpha_b$ of the chunk in the vertical direction (Step S94: No), in other words, in a case where it is determined that $1/\alpha_b$ of the chunk in the horizontal direction $1/\alpha_b$ of the chunk in the vertical direction, the chunk determining unit 116 determines whether $1/\alpha_b$ of the chunk in the horizontal direction $<1/\alpha_b$ of the chunk in the vertical direction (Step S97).

In a case where it is determined that $1/\alpha_b$ of the chunk in the horizontal direction $<1/\alpha_b$ of the chunk in the vertical direction (Step S97: Yes), the chunk determining unit 116 determines $1/\alpha_b$ of the chunk in the vertical direction as $1/\alpha_b$ of the chunk (Step S98) and ends this process. In other words, the chunk determining unit 116 determines a larger one as $1/\alpha_b$ of the chunk. On the other hand, in a case where it is not determined that $1/\alpha_b$ of the chunk in the horizontal direction $<1/\alpha_b$ of the chunk in the vertical direction (Step S97: No), in other words, in a case where it is determined that $1/\alpha_b$ of the chunk in the horizontal direction$=1/\alpha_b$ of the chunk in the vertical direction, the chunk determining unit 116 determines $1/\alpha_b$ based on a hue priority level (Step S99). More specifically, one having a higher hue priority level of $1/\alpha_b$ of the chunk in the horizontal direction and $1/\alpha_b$ of the chunk in the vertical direction is set as $1/\alpha_b$ of the chunk. As priority levels, in order of highest to lowest priority level, for example, there are yellow, yellow-green, cyan, green, magenta, violet, red, and blue.

The light emission value calculating unit 74*b*, as above, determines the light emission value $1/\alpha$ of the partial area 126. The luminance gain value determining unit 82 calculates a luminance gain value G by performing a process similar to that of the first embodiment by using this light emission value $1/\alpha$. The light emission control unit 84 calculates a corrected light emission value $1/\alpha_M$ by using this light emission value $1/\alpha$ and the luminance gain value G and causes the light source units 62 to emit light.

In this way, the display device 10*b* according to the third embodiment calculates a light emission value $1/\alpha$ through chunk detection. Accordingly, the corrected light emission value $1/\alpha_M$ can be calculated more appropriately. The process of calculating the light emission value $1/\alpha$ through the chunk detection can be applied to the display device 10*a* according to the second embodiment.

First Application Example

Figure 16:
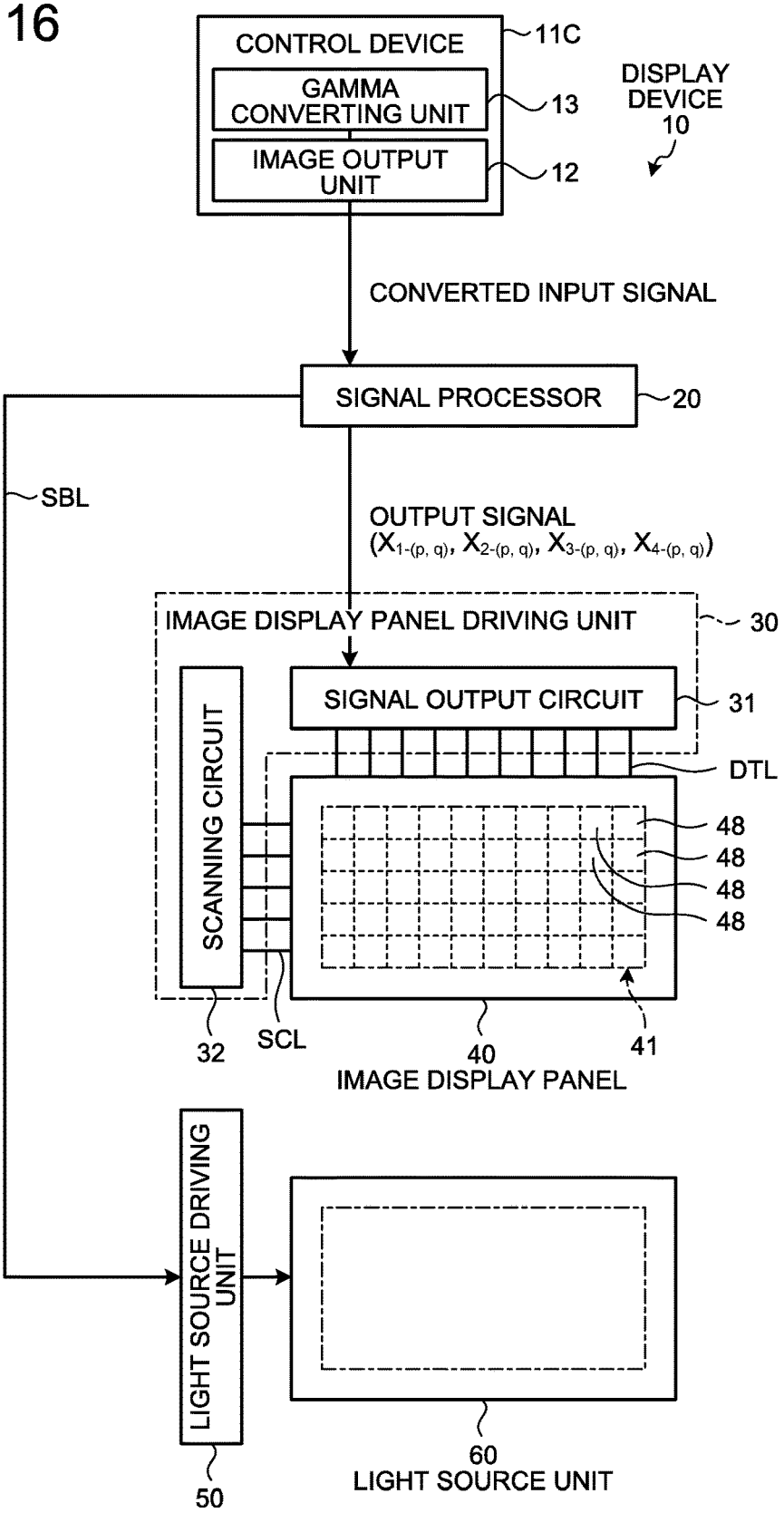
FIG. 16 is a block diagram that illustrates the configuration of a control device and a display device according to Application Example 1.

Next, a first application example of the display device 10 described above will be described. FIG. 16 is a block diagram that illustrates the configuration of a control device and a display device according to the first application example. As illustrated in FIG. 16, while the display device 10 according to the first application example is the display device according to the first embodiment, the display devices according to the second and third embodiments can be applied. A control device 11C according to the first application example includes a gamma converting unit 13. The gamma converting unit 13 generates a converted input signal by performing a gamma conversion of an input signal. The gamma converting unit 13 can perform a different gamma converting process for each partial area 126 or each area 124. In the first application example, the image output unit 12 outputs the converted input signal to the signal processor 20 as an input signal. For this converted input signal, the signal processor 20 performs a process that is similar to the process according to the first embodiment for an input signal and displays an image.

Figure 17:
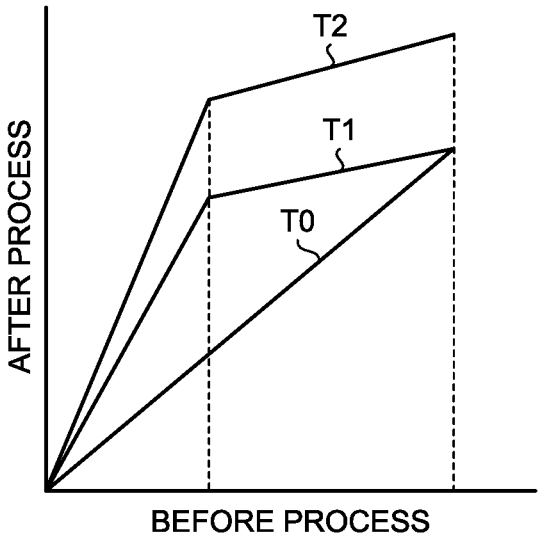
FIG. 17 is a graph that illustrates an output signal and an input signal according to a first application example.
Figure 18:
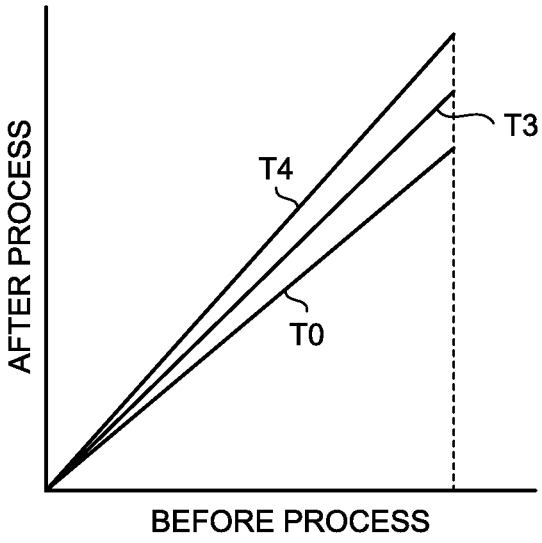
FIG. 18 is a graph that illustrates an output signal and an input signal according to the first application example.
Figure 19:
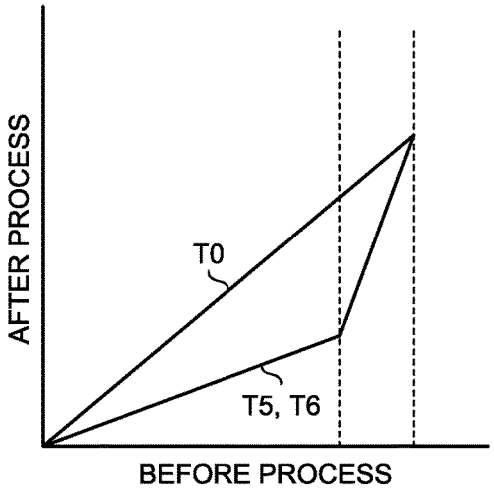
FIG. 19 is a graph that illustrates an output signal and an input signal according to the first application example.

FIGS. 17 to 19 are graphs that illustrate an output signal and an input signal according to the first application example. In FIGS. 17 to 19, the horizontal axis represents the luminance before processing, and the vertical axis represents the luminance after the processing. A segment T0 illustrated in FIG. 17 illustrates a case where any process is not performed for an input signal. A segment T1 illustrated in FIG. 17 represents a converted input signal acquired by performing a gamma conversion for the input signal represented in the segment T0 so as to upwardly protrude. A segment T2 illustrated in FIG. 17 represents an output signal of a case where the emission amount of light of the light source unit 62 is expanded by the signal processor 20 for the converted input signal of the segment T1. As represented in the segment T2, in a case where a converted input signal for which the gamma conversion is performed so as to upwardly protrude is input, by expanding the emission amount of light of the light source units 62 by using the signal processor 20, the luminance can be further raised with the upwardly protruding shape maintained.

A segment T3 illustrated in FIG. 18 represents a converted input signal acquired by performing a gamma conversion for the input signal represented in the segment T0 to sharpen the inclination. A segment T4 illustrated in FIG. 18 represents an output signal of a case where the emission amount of light of the light source units 62 is expanded by the signal processor 20 for the converted input signal of the segment T3. As represented in the segment T4, in a case where a converted input signal for which a gamma conversion is performed so as to sharpen the inclination is input, by expanding the emission amount of light of the light source units 62 by using the signal processor 20, the inclination is further sharpened, and accordingly, the luminance can be further raised.

A segment T5 illustrated in FIG. 19 represents a converted input signal acquired by performing a gamma conversion for the input signal represented in the segment T0 to decrease the luminance. A segment T6 illustrated in FIG. 19 represents an output signal of a case where the process of the signal processor 20 is performed for the converted input signal of the segment T5. A segment T6 is the same line as the segment T5. As represented in the segment T6, in a case where a converted input signal for which a gamma conversion is performed so as to downwardly protrude is input, the luminance is decreased, and accordingly, even in a case where the process of the signal processor 20 is performed, the luminance can be caused not to decrease by performing the process. In addition, in a case where one image is displayed, the gamma converting unit 13 can assign one of gamma conversions illustrated in FIGS. 17, 18, and 19 for each of different areas 124.

Second Application Example

Figure 20:
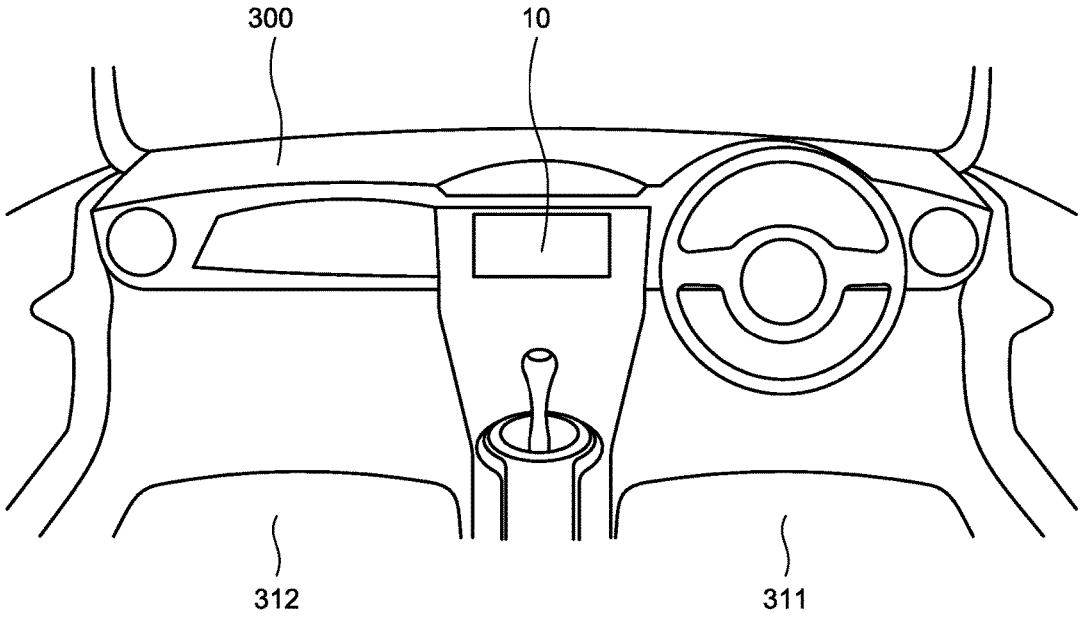
FIG. 20 is a diagram that illustrates an example of an electronic apparatus to which the display device according to the first embodiment is applied.
Figure 21:
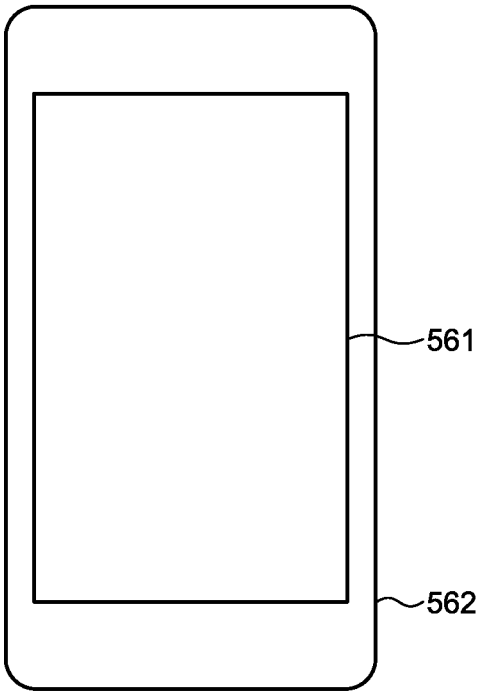
FIG. 21 is a diagram that illustrates an example of an electronic apparatus to which the display device according to the first embodiment is applied.

Next, an application example of the display device 10 described in the first embodiment with reference to FIGS. 20 and 21 will be described. FIGS. 20 and 21 are diagrams that illustrate examples of an electronic apparatus to which the display device according to the first embodiment is applied. The display device 10 according to the first embodiment can be applied to electronic apparatuses of all the fields such as a car navigation system illustrated in FIG. 20, a television apparatus, a digital camera, a notebook computer, a portable electronic apparatus such as a mobile phone illustrated in FIG. 21 or a video camera. In other words, the display device 10 according to the first embodiment can be applied to electronic apparatuses of all the fields displaying a video signal input from the outside or a video signal generated inside as an image or a video. The electronic apparatus supplies a video signal to the display device and includes the control device 11 (see FIG. 1) controlling the operation of the display device. In addition to the display device 10 according to the first embodiment, this application example can be applied also to the display devices according to the other embodiments described above.

The electronic apparatus illustrated in FIG. 20 is a car navigation apparatus to which the display device 10 according to the first embodiment is applied. The display device 10 is installed to a dashboard 300 inside a vehicle. More specifically, the display device 10 is installed between a driver seat 311 and a front passenger seat 312 of the dashboard 300. The display device 10 of the car navigation apparatus is used for a navigation display, a display of a music operation screen, a movie reproduction display, or the like.

An electronic apparatus illustrated in FIG. 21 operates as a portable computer, a multi-function mobile phone, a portable computer capable of performing a voice call, or a communicable portable computer to which the display device 10 according to the first embodiment is applied and is an information portable terminal that may be called as a so-called smartphone or a tablet terminal. This information portable terminal, for example, includes a display unit 561 on the surface of a casing 562. This display unit 561 has a touch detection (so-called touch panel) function enabling detection of an external approaching object by using the display device 10 according to the first embodiment.

As above, while the embodiments of the present invention have been described, such embodiments are not limited to the contents of the embodiments. In each constituent element described above, an element that can be easily considered by a person skilled in the art, an element that is substantially the same, and an element that is in a so-called equivalent range are included. In addition, the constituent elements described above may be appropriately combined. Furthermore, various omissions, substitutions, or changes of the constituent elements may be made in a range not departing from the concepts of the embodiments described above.

What is claimed is:

1. A display device comprising:

an image display panel in which a plurality of pixels are arranged in a matrix pattern;

a plurality of light sources that are respectively arranged in correspondence with a plurality of partial areas acquired by dividing the area of an image display surface of the image display panel, and that emit light to the corresponding partial areas; and a signal processor that controls the pixels based on an input signal of an image and controls emission amounts of light of the light sources, wherein the signal processor includes:

a light emission value calculating circuit that calculates a light emission value for each of the light sources based on the input signal, the light emission value is an emission amount of light of each of the light sources;

a luminance calculating circuit that calculates luminances of the pixels based on the input signal;

a chunk determining circuit that determines whether pixels within a predetermined luminance value range are continuously present among the pixels and determines an area of the continuous pixels as a chunk;

a maximum luminance value detecting circuit that detects a maximum luminance value for each of the partial areas, the maximum luminance value is a maximum luminance among luminances of the pixels disposed inside the chunk in one of the partial areas;

a luminance gain value determining circuit that determines a luminance gain value for each of the partial areas based on the maximum luminance value, such that a corrected light emission value that is a value acquired by multiplying the light emission value by the luminance gain value is a value of a predetermined upper limit emission value set in advance or less; and a light emission control circuit that causes the light sources to emit light based on the corrected light emission value.

2. The display device according to claim 1, wherein the luminance gain value determining circuit sets the luminance gain value to be larger as the corresponding partial area has a higher maximum luminance value.

3. The display device according to claim 1, wherein the luminance gain value determining circuit calculates the luminance gain value, such that the corrected light emission value for each of the partial areas is a value of an individual upper limit emission value or less, the individual upper limit emission value is set in advance as an upper limit emission amount of light that can be emitted by one of the light sources.

4. The display device according to claim 3, wherein the luminance gain value determining circuit calculates the luminance gain value, such that a sum value of the corrected light emission values for all the partial areas is a value of a sum upper limit emission value or less, the sum upper limit emission value is set in advance as an upper limit value of a sum of the emission amounts of all the light sources, and wherein the sum upper limit emission value is smaller than a value acquired by multiplying the individual upper limit emission value by a total number of the partial areas.

5. The display device according to claim 4, wherein the luminance gain value determining circuit includes:

an all-area maximum luminance value calculating circuit that detects an all-area maximum luminance value that is a maximum luminance among the maximum luminance values of all the partial areas;

a provisional luminance gain value calculating circuit that calculates a provisional luminance gain value for each of the partial areas, such that the provisional luminance gain value of the corresponding partial area having the all-area maximum luminance value is a set gain value set in advance, and the provisional luminance gain value is smaller as the corresponding partial area has a smaller maximum luminance value;

a corrected provisional luminance gain value calculating circuit that calculates a corrected provisional luminance gain value acquired by correcting the provisional luminance gain value for each of the partial areas, such that a value acquired by multiplying the corrected provisional luminance gain value by the light emission value is a value of the individual upper limit emission value or less; and a luminance gain value calculating circuit that calculates the luminance gain value acquired by correcting the corrected provisional luminance gain value for each of the partial areas, such that a sum value of values acquired by multiplying the luminance gain value by the light emission values for each of the partial areas is a value of the sum upper limit emission value or less.

6. The display device according to claim 4, wherein the luminance gain value determining circuit includes:

a raise value calculating circuit that calculates a raise value for each of the partial areas, the raise value is acquired by multiplying the light emission value by a set raise value set in advance;

a first corrected raise value calculating circuit that calculates a first corrected raise value that is a value acquired by correcting the raise value for each of the partial areas, such that the first corrected raise value has a smaller value as the corresponding partial area has a smaller maximum luminance value;

a margin calculating circuit that calculates a margin having a value acquired by subtracting a sum value of the light emission values for the partial areas from the sum upper limit emission value;

a second corrected raise value calculating circuit that calculates a second corrected raise value that is a value acquired by correcting the first corrected raise value for each of the partial areas, such that a sum value of the second corrected raise values of all the partial areas is a value of the margin or less;

a provisional luminance gain value calculating circuit that calculates a provisional luminance gain value for each of the partial areas, the provisional luminance gain value is acquired by dividing a value acquired by adding the light emission value to the second corrected raise value by the light emission value; and a luminance gain value calculating circuit that calculates the luminance gain value that is a value acquired by correcting the provisional luminance gain value for each of the partial areas, such that the corrected light emission value that is a value acquired by multiplying the luminance gain value by the light emission value is a value of the individual upper limit emission value or less.

7. An electronic apparatus comprising:

the display device according to claim 1; and a control device that controls the display device.

8. A method of driving a display device that includes an image display panel in which a plurality of pixels are arranged in a matrix pattern and a plurality of light sources that are respectively arranged in correspondence with a plurality of partial areas acquired by dividing the area of an image display surface of the image display panel and emit light to the corresponding partial areas, the method comprising:

a light emission value calculating step of calculating a light emission value for each of the light sources based on the input signal of the pixels, the light emission value, the light emission value is an emission amount of light of each of the light sources;

a chunk determining step of determining whether pixels within a predetermined luminance value range are continuously present among the pixels and determining an area of the continuous pixels as a chunk;

a maximum luminance value detecting step of detecting a maximum luminance value for each of the partial areas, the maximum luminance value is a maximum luminance among luminances of the pixels disposed inside the chunk in one of the partial areas;

a luminance gain value determining step of determining a luminance gain value for each of the partial areas based on the maximum luminance value, such that a corrected light emission value that is a value acquired by multiplying the light emission value by the luminance gain value is a value of a predetermined upper limit emission value set in advance or less; and a light emission controlling step of causing the light sources to emit light based on the corrected light emission value.

9. A display device comprising:

an image display panel in which a plurality of pixels are arranged in a matrix pattern;

a plurality of light sources that are respectively arranged in correspondence with a plurality of partial areas acquired by dividing the area of an image display surface of the image display panel and emit light to the corresponding partial areas; and a signal processor that controls the pixels based on an input signal of an image and controls emission amounts of light of the light sources, wherein the signal processor includes:

a light emission value calculating circuit that calculates a light emission value for each of the light sources based on the input signal, the light emission value is an emission amount of light of each of the light sources;

a luminance calculating circuit that calculates luminances of the pixels based on the input signal;

a chunk determining circuit that determines whether pixels within a predetermined luminance value range are continuously present among the pixels and determines an area of the continuous pixels as a chunk;

a maximum luminance value detecting circuit that detects a maximum luminance value for each of the partial areas, the maximum luminance value is a maximum luminance among luminances of the pixels disposed inside the chunk in one of the partial areas; and a luminance gain value determining circuit that determines a luminance gain value for each of the partial areas based on the maximum luminance value, such that a corrected light emission value that is a value acquired by multiplying the light emission value by the luminance gain value is a value of a predetermined upper limit emission value set in advance or less, and the luminance gain value is larger as the corresponding partial area has a higher maximum luminance value.

10. A display device comprising:

an image display panel in which a plurality of pixels are arranged in a matrix pattern;

a plurality of light sources that are respectively arranged in correspondence with a plurality of partial areas acquired by dividing the area of an image display surface of the image display panel and emit light to the corresponding partial areas; and a signal processor configured to control the pixels based on an input signal of an image and controls emission amounts of light of the light sources, determine a light emission value based on the input signal corresponding to a first partial area among the plurality of partial areas, determine a luminance gain value corresponding to the first partial area based on a maximum luminance value of a first chunk in which first pixels within a predetermined luminance value range are continuously present among the pixels, determine the luminance gain value to be larger as the maximum luminance value among the first pixels has a higher value, and set a corrected light emission value for the first partial area by multiplying the luminance gain value and the light emission value.

11. A display device comprising:

an image display panel in which a plurality of pixels are arranged in a matrix pattern;

a plurality of light sources that are respectively arranged in correspondence with a plurality of partial areas acquired by dividing the area of an image display surface of the image display panel and emit light to the corresponding partial areas; and wherein the display device controls the pixels based on an input signal of an image and controls emission amounts of light of the light sources, the display device determines a light emission value based on the input signal corresponding to a first partial area among the plurality of partial areas, the display device determines a corrected light emission value corresponding to the first partial area based on a maximum luminance value of a first chunk in which first pixels within a predetermined luminance value range are continuously present among the pixels, the corrected light emission value being larger as the maximum luminance value among the first pixels has a higher value, and the display device sets a corrected light emission value for the first partial area.

* * * * *